US010556646B2

(12) United States Patent
Nandigama et al.

(10) Patent No.: US 10,556,646 B2
(45) Date of Patent: Feb. 11, 2020

(54) MODULAR-TYPE VERY LARGE FLOATING STRUCTURES

(71) Applicant: Sea6 Energy Pvt. Ltd., Bangalore (IN)

(72) Inventors: Chaitanya Praveen Nandigama, Hyderabad (IN); Rajesh Kumar Reddy Katreddy, Bangalore (IN); Nelson Vadassery, Bangalore (IN)

(73) Assignee: Sea6 Energy Pvt. Ltd., Bangalore (IN)

( * ) Notice: Subject to any disclaimer, the term of this patent is extended or adjusted under 35 U.S.C. 154(b) by 0 days.

(21) Appl. No.: 16/070,740

(22) PCT Filed: Jan. 20, 2017

(86) PCT No.: PCT/IN2017/050032
§ 371 (c)(1),
(2) Date: Jul. 17, 2018

(87) PCT Pub. No.: WO2017/125953
PCT Pub. Date: Jul. 27, 2017

(65) Prior Publication Data

US 2019/0023358 A1 Jan. 24, 2019

(30) Foreign Application Priority Data

Jan. 20, 2016 (IN) ..... 201641002183

(51) Int. Cl.
*B63B 35/44* (2006.01)
*B63C 1/02* (2006.01)
*E01D 15/14* (2006.01)

(52) U.S. Cl.
CPC ..... *B63B 35/44* (2013.01); *B63B 2035/4426* (2013.01); *B63B 2035/4453* (2013.01);
(Continued)

(58) Field of Classification Search
CPC . B63B 35/44; B63B 2035/4426; B63B 9/065; B63B 2241/08; B63C 1/02
See application file for complete search history.

(56) References Cited

U.S. PATENT DOCUMENTS

2 A * 7/1836 Goulding ..... C02F 1/00 57/58.49
42 A * 10/1836 Platt ..... F21S 8/065 362/406

(Continued)

FOREIGN PATENT DOCUMENTS

CN 102 390 495 A 3/2012
JP 2006/131025 A 5/2006

(Continued)

OTHER PUBLICATIONS

International Search Report and Written Opinion issued for International Application No. PCT/IN2017/050032 dated Jun. 27, 2017, 10 pages.

*Primary Examiner* — S. Joseph Morano
*Assistant Examiner* — Jovon E Hayes
(74) *Attorney, Agent, or Firm* — Foley & Lardner LLP

(57) ABSTRACT

A floating structure based on the tensegrity principle is described. A planar closed loop structure (1700) has a plurality of beams (300) and a plurality of beam adapters (700). Each of the plurality of beams (300) is formed by coupling multiple n-strut twisted prism units. Each of the multiple n-strut twisted prism units includes n-sided planar polygonal surfaces on opposite sides through which the respective n-strut twisted prism unit is coupled to another n-strut twisted prism unit or a beam adapter. Each of the plurality of beam adapters (700) is an m-strut twisted prism unit having planar polygonal side faces for coupling to an n-sided planar polygonal surface of a beam (300).

20 Claims, 29 Drawing Sheets

(52) U.S. Cl.
CPC ..... *B63B 2241/08* (2013.01); *B63B 2241/16* (2013.01); *B63C 1/02* (2013.01); *E01D 15/14* (2013.01)

(56) References Cited

U.S. PATENT DOCUMENTS

| | | | | |
|---|---|---|---|---|
| 4,290,381 | A | 9/1981 | Penman | |
| 6,901,714 | B2 | 6/2005 | Liapi | |
| 8,251,002 | B2 | 8/2012 | Wang et al. | |
| 8,616,328 | B2 * | 12/2013 | Daraio | G10K 15/00 181/175 |
| 2006/0027071 | A1 * | 2/2006 | Barnett | G10D 13/08 84/402 |
| 2006/0102088 | A1 | 5/2006 | Wroldsen et al. | |
| 2007/0223306 | A1 * | 9/2007 | Toennessen | G01V 1/3808 367/15 |
| 2013/0298841 | A1 | 11/2013 | Vadassery et al. | |
| 2014/0037873 | A1 * | 2/2014 | Cheung | B32B 3/06 428/34.1 |
| 2015/0259050 | A1 | 9/2015 | Tunbjer | |
| 2019/0023358 | A1 * | 1/2019 | Nandigama | B63B 9/065 |

FOREIGN PATENT DOCUMENTS

| | | | | |
|---|---|---|---|---|
| WO | WO 2016/052146 | | 5/2006 | |
| WO | WO-2006052146 | A1 * | 5/2006 | A01K 61/60 |

* cited by examiner

MODULAR-TYPE VERY LARGE FLOATING STRUCTURES

RELATED APPLICATIONS

This application is a U.S. National Stage of International Application No. PCT/IN2017/050032, filed on Jan. 20, 2017 and claiming the benefit of and priority to Indian Patent Application No. 201641002183, filed Jan. 20, 2016, both of which are hereby incorporated by reference in their entireties.

TECHNICAL FIELD

The present subject matter relates, in general, to floating structures, and particularly to modular-type very large floating structures for sea.

BACKGROUND

Seventy percent of the Earth's surface is occupied with water in form of oceans, seas, rivers, etc. Thus, floating structures may provide usable space on surface of oceans and seas as an alternative to land. The floating structures may be utilized for various purposes such as building large scale seaweed farms, aquaculture, ocean farming, bridges, docks, manmade islands, and establishing large solar farms on the ocean. The class of floating structures for such purposes is referred to as very large floating structures (VLFS).

Oceans and seas may have very rough environment and the VLFS deployed there may face significant challenges. Strong ocean currents and powerful waves pose huge threats to the integrity of the structure of the VLFS. Several designs and structures for the offshore structures designs have been proposed in literature to address such challenges. For example, U.S. Pat. No. 8,251,002 discloses a pontoon based structure. The pontoon based structure is a set of buoyant chambers and non-buoyant chambers that keep the structure afloat while the upper deck supports external loads. Similarly, U.S. Pat. No. 4,290,381 utilizes D'Alemberts principle to counter the effects of waves by using a large disc made out of concrete and/or steel. Further, US patent publication number 20130298841 describes a flexible floating structure that uses of a flexible joint based design for the flexibility. These joints can be made out of hinge joints, ball socket joints, pivot joints or similar joints.

BRIEF DESCRIPTION OF DRAWINGS

The features, aspects, and advantages of the subject matter will be better understood with regard to the following description, and accompanying figures. The use of the same reference number in different figures indicates similar or identical features and components.

FIG. 12(*b*) illustrates a 12-strut twisted prism unit with extended side faces, in accordance with an implementation of the present subject matter.

DETAILED DESCRIPTION

Figure 1:
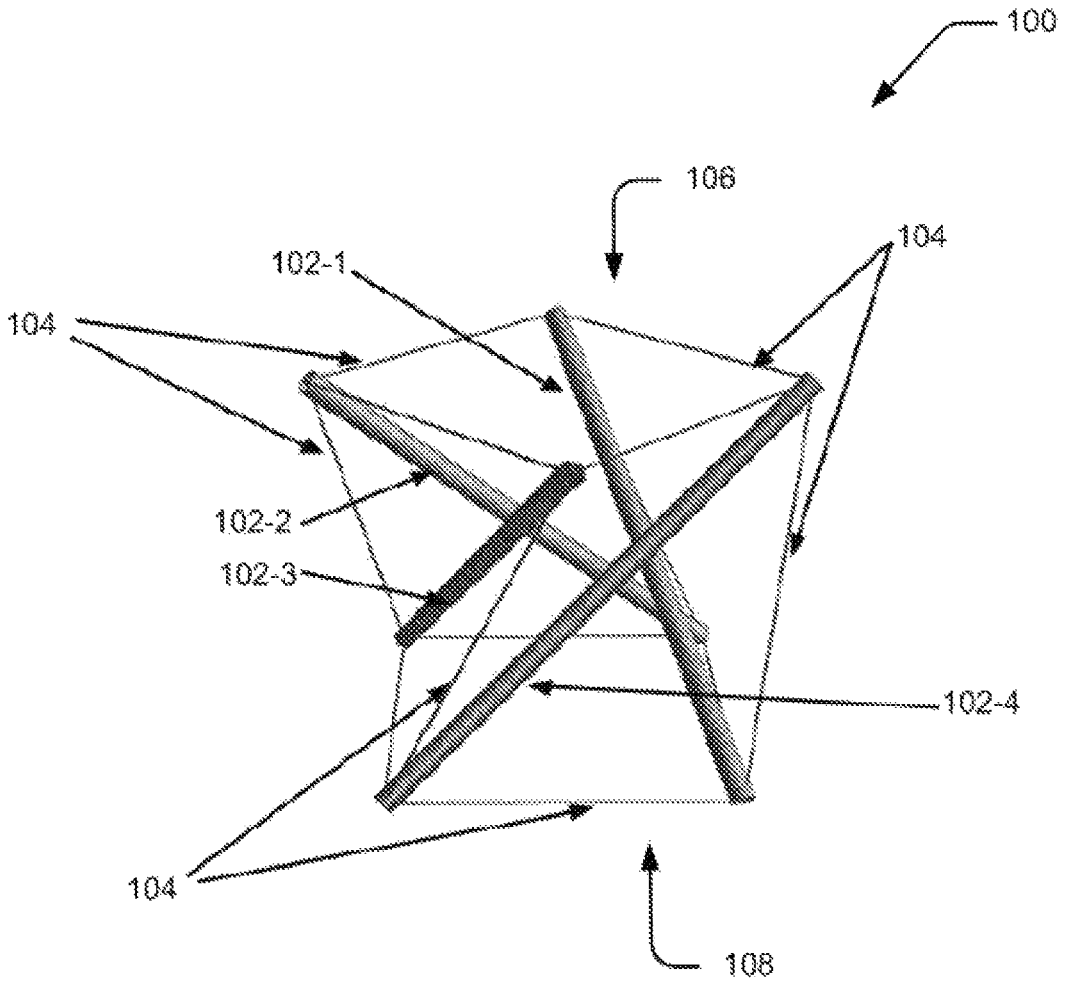
FIG. 1 illustrates a 4-strut twisted prism unit based on tensegrity principle, in accordance with an implementation of the present subject matter.

Generally, very large floating structures (VLFS) can be classified into two broad categories: Rigid and Flexible. A rigid VLFS may experience very high stresses as they resist the entire force instead of conforming to it. This results in tremendous stresses on the materials and the amount of material required to construct a rigid VLFS can be very high. On the contrary, a flexible VLFS adapts itself to the wave profile and undergoes lower stresses compared to a VLFS structure that is rigid. Therefore, the flexible VLFS requires less material but requires some flexible elements. The flexible VLFS may incorporate actively moving parts. The actively moving parts may undergo wear and tear and affect the lifetime of the structure. In particular, in extreme conditions in oceans, when the forces are enormous, the rate of wear and tear of the actively moving parts is quite high and leads to very low lifetime of the structure. Thus, the overall lifetime expenditure on flexible VLFS may be very high.

The forces experienced by the VLFS in the oceans are also dependent on the way the structure is anchored to the ocean floor. Typically, the VLFS with single large anchor are more likely to face higher loads at the anchoring point. The VLFS are built with a very small unit of the structure near the anchoring point holding the entire floating structures. This may result in localized structure failure. Thus, multiple anchors are required to be deployed if the maximum load on the VLFS has to be kept within the limits. The multiple anchoring points may be strategically placed to attach anchors. However, having multiple anchors in a VLFS and along with the efforts of installing these multiple anchors on the ocean floor may increase the overall cost of the structure. The VLFS may get even more costly when the multiple anchors are to be installed in deep seas. Installing anchors in deep water is a huge hassle. Therefore, a VLFS should have a minimum number of anchors.

The subject matter disclosed herein relates to modular-type very large floating structure (VLFS). The modular VLFS of the present subject matter has a structure that effectively distributes a load applied to any location of the structure to the entire structure system.

In one implementation, the modular VLFS includes a closed loop tensegrity structure. The closed loop tensegrity structure is a combination of beams and beam adapters. The beams may be arranged to form edges of the closed loop tensegrity structure. The beam adapters couple the adjacent beams and may form vertices of the closed loop tensegrity structure. Each of the beams is formed by coupling multiple n-strut tensegrity modules where n is an integer greater than 2. Each of the multiple n-strut tensegrity modules has a structure of a twisted prism. An n-strut tensegrity module is alternatively referred to as n-strut twisted prism unit herein after. Each of the multiple n-strut twisted prism units includes n-sided planar polygonal surfaces on opposite sides. An n-strut twisted prism unit is coupled to another n-strut twisted prism unit or a beam adapter from the n-sided planar polygonal surfaces.

In an example implementation, the closed loop structures may have one or more edges formed by weaving adjacent beams with cables or tethers. The inherent stiffness of the structure formed by arranging the beams and the beam adapters maintain the shape of the closed loop structures despite one edge being a flexible cable.

Each of the beam adapters is an m-strut tensegrity module where m is an integer greater than 4. The m-strut tensegrity module has a structure of a twisted prism. The m-strut tensegrity module is alternatively referred to as m-strut twisted prism unit herein after. The m-strut twisted prism unit has n-sided planar polygonal surfaces on opposite sides and at least m number of side faces formed as planar polygons. A beam adapter is coupled to a beam from one of the at least m number of side faces.

In one implementation, the modular VLFS has structures comprising the beams formed from 4-strut tensegrity modules and the beam adapters formed from 6-strut tensegrity module. The structures are formed by combining beams to beam adapters. The 4-strut and 6-strut tensegrity modules utilize the tensegrity principle, where the struts are spatially constrained by the pre-tensioned ropes.

In one implementation, an n-strut tensegrity module has four struts where each strut, based on the tensegrity principle, is inclined about their vertical and horizontal axes and tied with the pre-tensioned ropes, such that the n-strut tensegrity module has two n-sided polygonal planar surfaces and n number of quadrilateral side faces. The multiple n-strut tensegrity modules may be joined one over the other and about the n-sided polygonal surfaces.

In one implementation, the m-strut tensegrity module has m number of struts where each strut, based on the tensegrity principle, is inclined about their vertical and horizontal axes and tied with the pre-tensioned ropes, such that the m-strut tensegrity module has two m-sided polygonal surfaces and at least m number of side faces. The m-strut tensegrity module has planar side faces where the beam may be joined at any of the planar side faces.

The modular VLFS of present subject matter provides structures that effectively respond to the environmental loads from the oceans. The structures, being based on tensegrity principle, may distribute any load applied at any location of the structures, such that the load is supported by the entire structure system. As a result, the amount of material required to design individual components would come down drastically. This is because any localized load is immediately distributed across the structures leading to lower individual component loads. Thus, the entire material of the structure is efficiently utilized. Also, the dependency on the location of anchors and number of anchors will also come down as the loads are quickly distributed across the structure. As a result, the overall lifetime cost of VLFS may be reduced.

In one implementation, one of n-sided planar polygonal surfaces of an n-strut twisted prism unit is coupled with one of n-sided planar polygonal surfaces of another n-strut twisted prism unit through joints such as ring joints, eyebolts, ball joints, and a ball and socket arrangement. Such joints may result in more stable modular VLFS and prevent the distortion of the structures when a load is being applied at any location of the structures or the load is being distributed through the entire structures.

The manner in which the modular VLFS shall be implemented has been explained in details with respect to FIG. 1 to FIG. 34. It should be noted that the description and figures merely illustrate the principles of the present subject matter.

Tensegrity refers to tensional integrity. Biological systems have one of the most efficient structures owing to millions of years of evolution learning to adapt to the environment. For example, in humans, the complex interconnected muscle fibers around the spinal cord help us lift weights more than an individual muscle fiber or bone alone as an independent unit. This is owing to the synergy with which these muscle fibers work with the bones. Tensegrity is one such design philosophy which, when implemented effectively, can act in close resemblance to biological structures. Further, a tensegrity structure can be defined as a structure whose compressive elements are spatially constrained by pre-tensioned ropes. These ropes could be replaced with other pre-tensioned elements like cables, wires, or even chains.

The principle of tensegrity is used for applications in fish culture as described in US patent publication number 20060102088. U.S. Pat. No. 8,616,328 describes a wave generator based on the tensegrity principles. U.S. Pat. No. 6,901,714 describes a method of construction which uses tensegrity modules with continuous tension elements. Further, patent publication number WO2006052146A1 and US20060102088 explains designing of tensegrity structures which have their applications in the field of aquaculture which have the ability to control, shape, motion and vibration.

FIG. 1 illustrates a 4-strut twisted prism unit 100 based on tensegrity principle, in accordance with an implementation of the present subject matter. The 4-strut twisted prism unit 100 includes four struts 102-1, 102-2, 102-3, 102-4 (collectively referred to as 102) and pre-tensioned ropes 104. Based on the principle of tensegrity, the four struts 102 are spatially constrained by the pre-tensioned ropes 104. As a result, the struts 102 are under constant compressive loads, i.e., irrespective of the direction and magnitude of the loads applied on the pre-tensioned ropes 104, the struts 102 are always under compression. The 4-strut twisted prism unit 100 is obtained by rotating the two parallel rectangular surfaces of a 4-strut regular prism with respect to each other by an angle in a range of 135° to 180°, such that, the four struts 102 aligns with respect to planes of the two rectangular surfaces. The aligned four struts are tied with the pre-tensioned ropes to form a spatially constrained 4-strut tensegrity module.

Referring to FIG. 1, the two planar rectangular surfaces of the 4-strut twisted prism unit 100 may be referred to as a top surface 106 and a bottom surface 108. The top surface 106 has four vertices where each of the vertices is formed by a first end of a corresponding strut 102. Further, the top surface 106 has four edges where each of the edges if formed by a pre-tensioned rope 104 attached to the first ends of two adjacent struts 102. The bottom surface 108 has four vertices where each of the vertices is formed by a second end of a corresponding strut 102. Further, the bottom surface 108 has four edges where each of the edges is formed by a pre-tensioned rope 104 attached to the second ends of the two adjacent struts 102.

Figure 2:
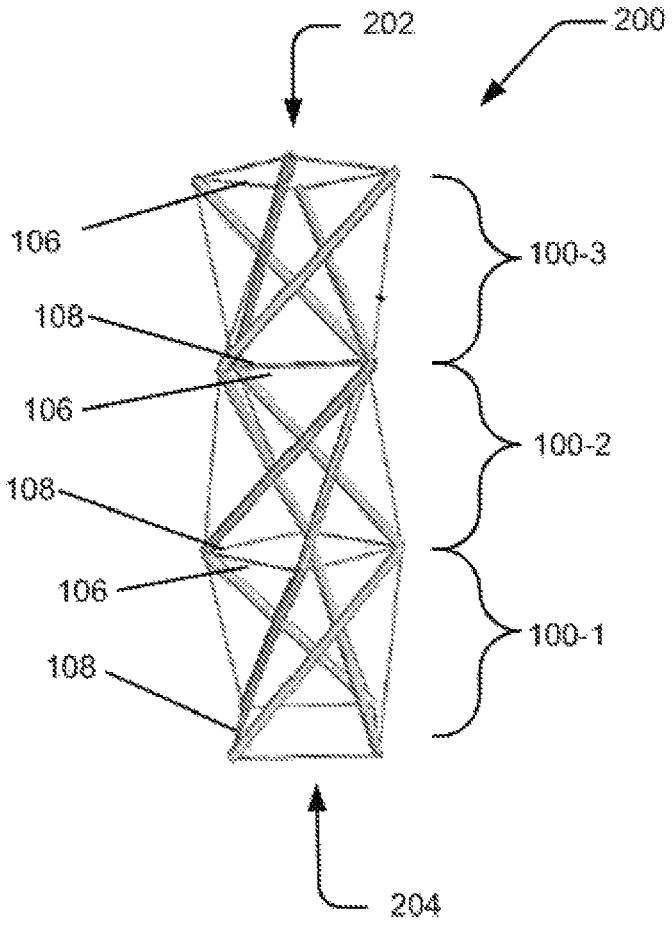
FIG. 2, FIG. 3, and FIG. 4 illustrate a tensegrity beam, in accordance with an implementation of the present subject matter.

FIG. 2 illustrates a tensegrity beam 200 formed by joining three 4-strut twisted prism units, as an example implementation of the present subject matter. The tensegrity beam is alternatively referred as beam hereinafter. For illustration purpose the beam 200 is shown to have three 4-strut twisted prism units 100. In practical implementation, the beam may be formed by more than three 4-strut twisted prism units 100 or the beam may be formed by less than three 4-strut twisted prism units 100. The beam 200 is formed by coupling the top surface 106 of the 4-strut twisted prism unit 100-1 to the bottom surface of the another 4-strut twisted prism unit 100-2.

Figure 3:
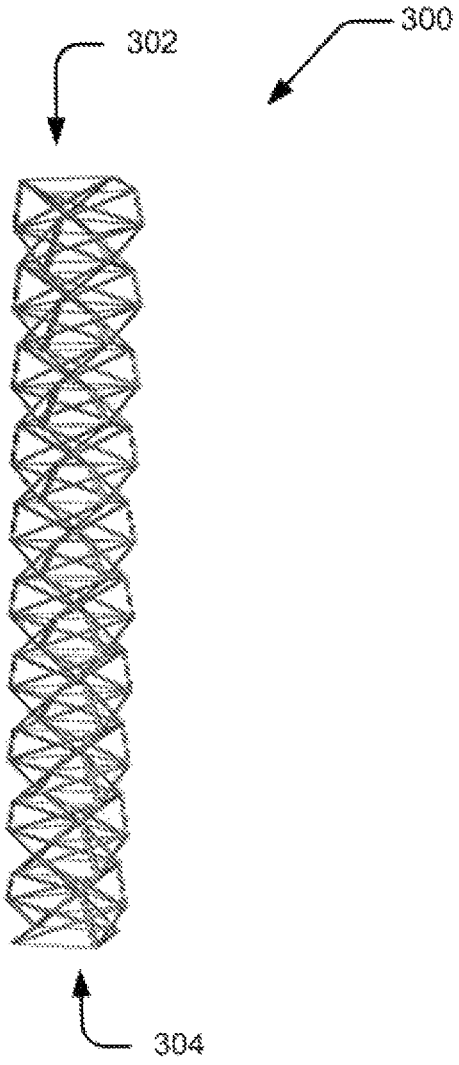

Referring to FIG. 2, the beam 200 has a first end 202 formed of a top surface 106 of a 4-strut twisted prism unit 100-3 and a second end 204 formed of a bottom surface 108 of the 4-strut twisted prism unit 100-1. FIG. 3 illustrates a tensegrity beam 300 formed by joining twenty 4-strut twisted prism units 100, as an example implementation of the present subject matter. In another example implementation, the beam 200 may be a single 4-strut twisted prism unit 100.

Figure 4:
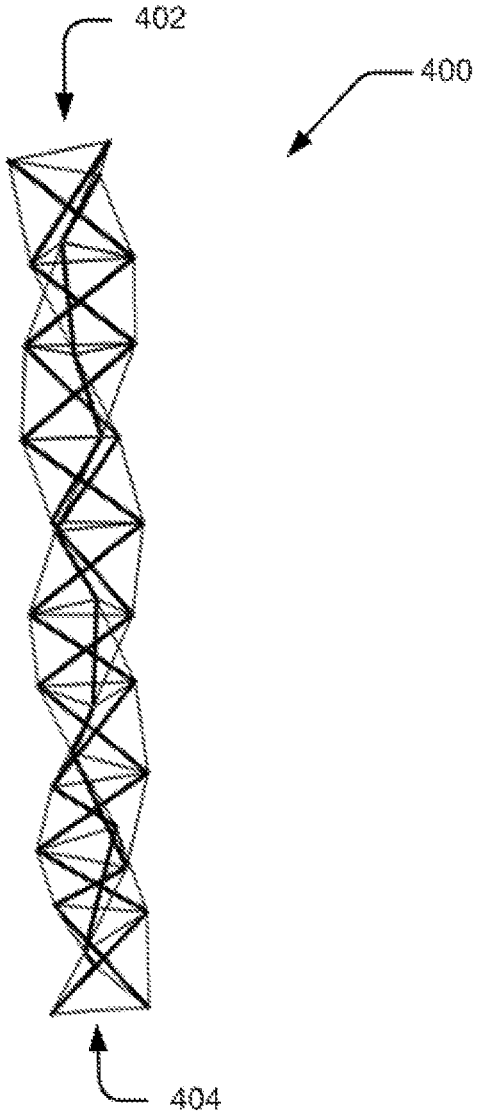

Similar to the 4-strut twisted prism unit 100, a 3-strut twisted prism unit or a 5 strut twisted prism unit may be formed based on the tensegrity principle. Thus, a beam may be formed by coupling multiple n-strut twisted prism units where 'n' is an integer greater than or equal to 3. The beam formed by coupling multiple n-strut twisted prism units may have a first end and a second end formed as n-sided planar polygonal surfaces. FIG. 4 illustrates a tensegrity beam 400 formed by joining nine 3-strut twisted prism units, as an example implementation of the present subject matter. The beam 400 has a first end 402 and a second end 404 formed as planar triangular surfaces.

In an example implementation, referring to FIG. 2 and FIG. 3, two n-strut twisted prism units 100 may be joined by strut to strut connection. The structure having strut to strut connection is comparatively more rigid than a structure assembled through the pure tensegrity method, for the same materials and pretension. Referring to FIG. 2, the strut to strut connection is established by joining the vertices formed at the top surface 106 of the n-strut twisted prism unit 100-1 to the vertices formed at the bottom surface 108 of the n-strut twisted prism unit 100-2. Similarly, the vertices formed at the top surface 106 of the n-strut twisted prism unit 100-2 are joined to the vertices formed at the bottom surface 108 of the n-strut twisted prism unit 100-3

Figure 5:
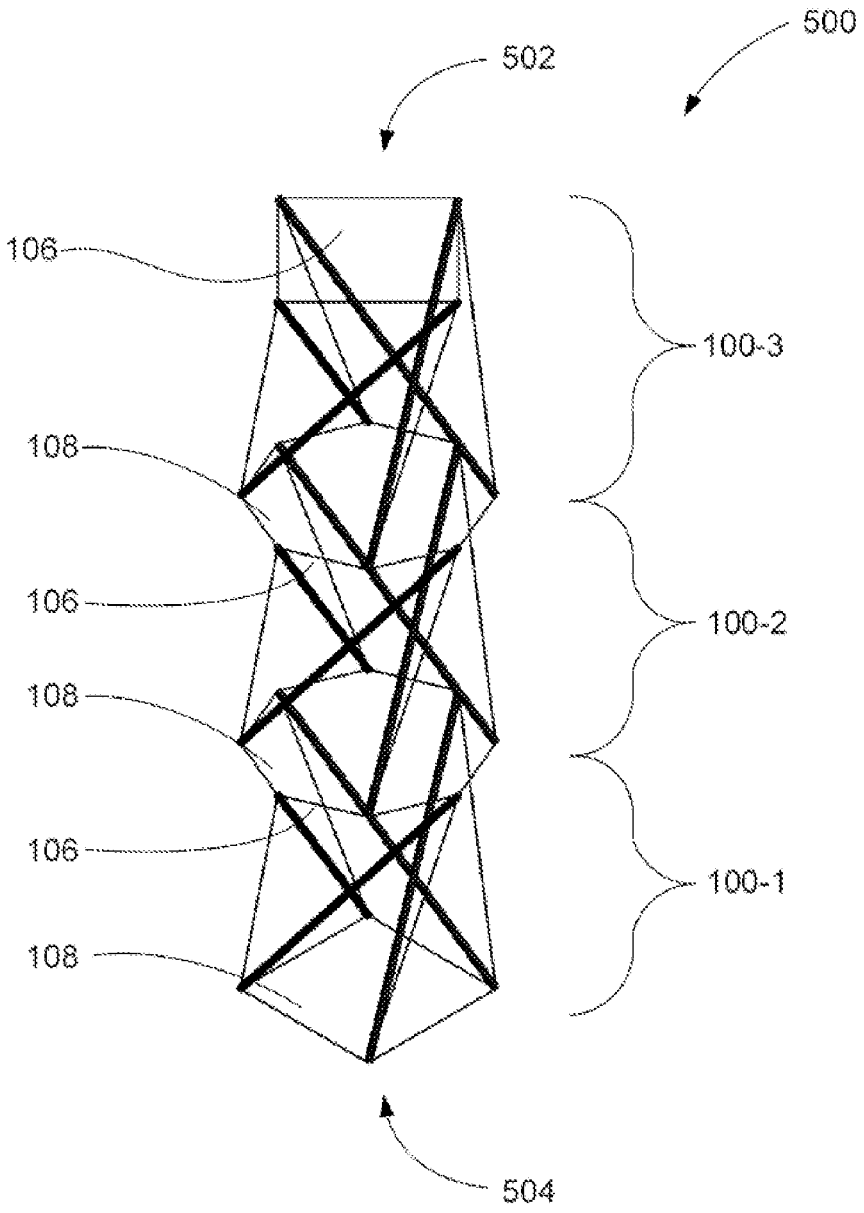
FIG. 5 illustrates a tensegrity beam formed by strut to pre-tensioned rope connection between the 4-strut twisted prism units of FIG. 1, in accordance with an implementation of the present subject matter.

In another example implementation, two n-strut twisted prism units 100 are joined by strut to pre-tensioned rope connection. FIG. 5 illustrates a tensegrity beam 500 formed by strut to pre-tensioned connection between 4-strut twisted prism unit, as an example implementation of the present subject matter. Referring to FIG. 5, the strut to pre-tensioned rope connection is established by joining vertices formed at a top surface 106 of an n-strut twisted prism unit 100-1 to the edges at a bottom surface 108 of another n-strut twisted prism unit 100-2. Further, vertices formed at the bottom surface 108 of the n-strut twisted prism unit 100-2 are joined to the edges at the top surface 106 of the n-strut twisted prism unit 100-2. In a similar way, a top surface 106 of the n-strut twisted prism unit 100-2 is joined to a bottom surface 108 of another n-strut twisted prism unit 100-3.

The strut to pre-tensioned rope connection prevents any direct contact of struts of two n-strut twisted prism units 100. The strut to pre-tensioned rope connection, as illustrated in FIG. 5, is pure form of tensegrity structure. The beam 500 obtained from strut to pre-tensioned rope connection is comparatively more flexible than the beam 200, in FIG. 2, obtained from the strut to strut connection.

A structure of the beam 500 obtained by coupling the multiple n-strut twisted prism unit units based on the strut to pre-tensioned rope connection may be referred to as class-1 structure. A structure of the beam 200, 300, and 400 obtained by coupling the multiple n-strut twisted prism units based on the strut to strut connection may be referred to as class-2 structure.

The n-sided planar polygonal surfaces of the n-strut twisted prism units have edges of equal length. Referring to FIG. 1, the top surface 106 and the bottom surface 108 of the n-strut twisted prism unit 100 have congruent polygons.

Further, referring to FIG. 2 and FIG. 5, two n-strut twisted prism units 100 are coupled to each other when a polygon formed at the top surface 106 of the n-strut twisted prism unit 100-1 is congruent to the polygon formed the bottom surface 108 of the n-strut twisted prism unit 100-2, i.e. edges of the n-sided planar polygonal surfaces of respective the n-strut twisted prism units 100-1 and 100-2 are equal in length. The beam 200, 300, and 500 obtained by coupling multiple n-strut twisted prism units 100 having congruent polygons is referred to as a uniform beam.

In an example implementation, edges of an n-sided planar polygonal surface of an n-strut twisted prism unit are smaller than the edges of another n-sided planar polygonal surface of opposite side. Therefore, two n-strut twisted prism units are coupled by respective n-sided planar polygonal surfaces of equal edges. For example, edges 104 of the top surface 106 may be smaller than the edges of the bottom surface 108 of the 4-strut twisted prism unit 100 of FIG. 1. Therefore, the 4-strut twisted prism unit 100 is coupled to another 4-strut twisted prism unit 100 when length of edges of the top surface 106 the 4-strut twisted prism unit 100 is equal to the length of edges of a bottom surface 108 of another 4-strut twisted prism unit.

Figure 6:
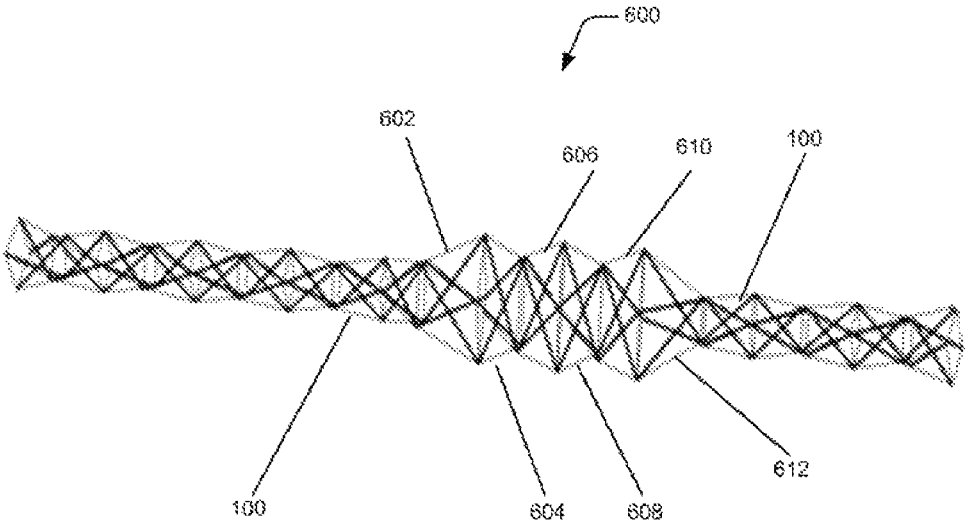
FIG. 6 illustrates a non-uniform tensegrity beam, in accordance with an implementation of the present subject matter.

FIG. 6 illustrates a non-uniform tensegrity beam 600, in accordance with an implementation of the present subject matter. As shown in FIG. 6, the n-strut twisted prism units 602, 604, . . . 612 have n-sided planar polygonal surfaces with edges of variable lengths. Two n-strut twisted prism units 602 and 604 are coupled by respective n-sided planar polygonal surfaces of edges of equal length. The n-strut twisted prism unit 602 is coupled to the n-strut twisted prism unit 604 when the length of edges of one of n-sided planar polygonal surfaces are equal to the length of edges of one of n-sided planar polygonal surfaces of the n-sided polygon 604. Similarly, others n-sided twisted prism units 606, 608, . . . 612 are coupled by respective n-sided planar polygonal surfaces having edges of equal length.

Further, the beams 200, 300, 400, 500, and 600 have first ends and the second ends with planar polygons. The beams 200, 300, 400, 500, and 600 are coupled to a beam adapter from their first ends or second ends.

Referring to FIG. 2-FIG. 6, the coupling of two n-strut twisted prism units 100, 602 by respective n-sided planar polygonal surfaces may result in formation of common vertices at the joints in a strut to strut connection. Further, the common vertices may result in common pre-tensioned ropes attached to the ends of the struts of two n-strut twisted prism units. In an example implementation, the coupling of n-strut twisted prism units 100, 602 may have common vertices at the joins in the strut to strut connection and may have separate pre-tensioned ropes attached to the respective ends of the struts of the two n-strut twisted prism units.

The tensegrity beams 200, 300, 400, 500, and 600 are arranged to obtain a closed loop tensegrity structures of various geometries. The tensegrity beams 200, 300, 400, 500, and 600 are coupled to each other by beam adapters. The beam adapters are twisted prism units based on the tensegrity principle. A beam adapter has a top surface, a bottom surface and plurality of side faces. The top surface, the bottom surface and the plurality of side faces are planar. The top surface and the bottom surface are parallel to each other. The plurality of side faces has corresponding planes substantially perpendicular to the planes of the top surface and the bottom surface. Any side face of the plurality of side faces is coupled to one of the first end and the second end of the beam 200, 300, 400, 500, and 600 by the strut to strut connection, as explained above. The beam adapter is a m-strut twisted prism unit, where m is greater than or equal to 4.

Figure 7:
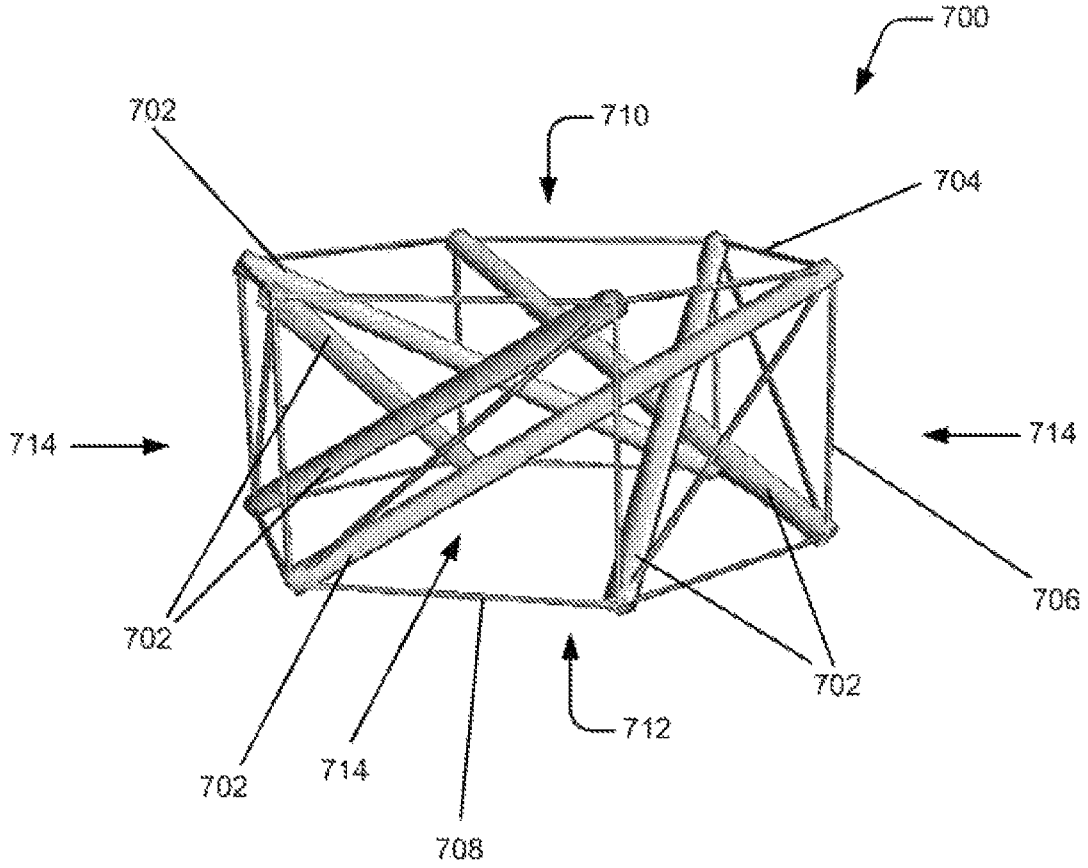
FIG. 7 illustrates a 6-strut twisted prism unit based on tensegrity principle, in accordance with an implementation of the present subject matter.

FIG. 7 shows a 6-strut twisted prism unit 700 based on tensegrity principle, in accordance with an implementation of the present subject matter. The 6-strut twisted prism unit 700 also referred to as a twisted hexagonal tensegrity module. Here, six struts 702 are positioned and inclined based on the principle of tensegrity. Further, the six struts 702 are spatially constrained by the pre-tensioned ropes 704, 706, and 708. The specialty of the 6-strut twisted prism unit 700 is that it has a hexagonal top surface 710, a hexagonal bottom surface 712, and at least six planar side faces 714. As shown in FIG. 7, the pre-tensioned ropes 704 are connected to the ends of the struts 710 to form edges of a hexagonal top surface 710. Similarly, the pre-tensioned ropes 708 are connected to the other ends of the struts 710 to form edges a hexagonal bottom surface 712, and the pre-tensioned ropes 704, 706, and 708 are connected to the ends of the struts 702 to form edges of a rectangular planar side face 714. The side faces 714 are substantially perpendicular to the top surface 710 and the bottom surface 712. The 6-strut twisted prism unit 700 is coupled to the beams 200, 300, 500, and 600 by the side faces 714.

The presence of pre-tensioned ropes in the structures of the tensegrity modules described in any of the above mentioned figures make the structure inherently flexible, because pre-tensioned ropes do not resist in compression. The pre-tensioned ropes have minimal resistance to torsion in a tensegrity structure. Further, the pre-tensioned ropes are free to rotate at any point of contact or at a point of attachment in the tensegrity structure. The flexibility makes the structures generally unattractive for land based applications. But for marine environment, where flexibility is a desirable feature.

The 6-strut twisted prism unit 700 is obtained by rotating the two parallel hexagonal surfaces, i.e. the top surface 710 and the bottom surface 712, by an angle of 120° with respect to each other. Further, depending on the angle by which the top surface 710 is rotated with respect to the bottom surface 712, different configurations emerge.

Figure 8:
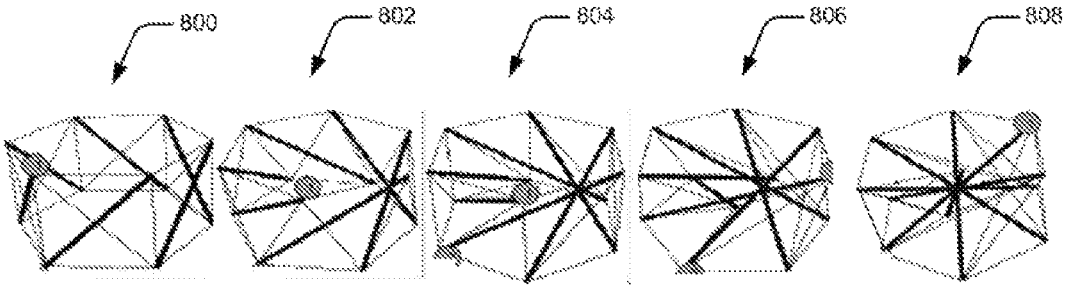
FIG. 8 illustrates 6-strut twisted prism unit configurations with different angle of rotation, in accordance with an implementation of the present subject matter.

As shown in the FIG. 8, different possible configuration obtained when the top surface 710 is rotated with respect to the bottom surface 712. Each of these configurations has a unique shape, strut length to pre-tensioned rope length ratio, and stability. The 6-strut twisted prism unit 800 is obtained by rotating the top surface 710 and the bottom surface 712 by an angle of 60° based on the formula 2*(180/n). Here, n is 6. The vertices of the top surface 710 are aligned with the vertices of the bottom surface 712. However, the structure of the 6-strut twisted prism unit 800 is not stable for making a tensegrity structure. The 6-strut twisted prism unit 802 is obtained by rotating the top surface 710 and the bottom surface 712 by an angle of 90° based on the formula 3*(180/n). The structure of the 6-strut twisted prism unit 802 is stable for making a tensegrity structure. However, the side faces are non-planar and the normal of the side faces do not lie in the same plane. The 6-strut twisted prism unit 804 is obtained by rotating the top surface 710 and the bottom surface 712 by an angle of 120° based on the formula 4*(180/n). The structure of the 6-strut twisted prism unit 804, similar to the structure of the 6-strut twisted prism unit 700, is stable for making a tensegrity structure and has planar side faces. Further, the normal to the planes of the side faces lie in the same plane. Thus, the beams coupled to the side faces also lie in same plane. Further, each of the side faces of the 6-strut twisted prism unit 804 has two triangles in the same plane forming an antiprism.

The 6-strut twisted prism units 806 and 808 are obtained by rotating the top surface 710 and the bottom surface 712 by angles of 150° and 180°, respectively, based on the formulae 4*(180/n) and 5*(180/n). The structure of the 6-strut twisted prism unit 806 is stable. However, the planes of the side faces are perpendicular to the hexagonal top surface and the hexagonal bottom surfaces of the 6-strut twisted prism unit 806. Further, twisting the top surface 710 and the bottom surface 712 by an angle 180° to obtain the structure referred by 808, may result in intersection of the struts. Therefore, struts in the 6-strut twisted prism unit 808 are not spatially constrained and cannot make a tensegrity structure.

Figure 9:
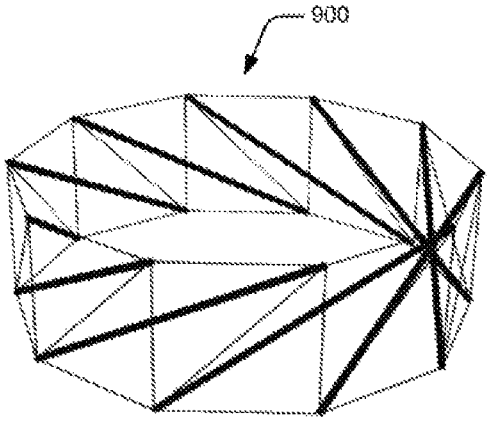
FIG. 9 illustrates a 10-strut twisted prism unit based on tensegrity principle, in accordance with an implementation of the present subject matter.

Similar to the 6-strut twisted prism unit 700, a 7-strut twisted prism unit, an 8-strut twisted prism unit, or a 9-strut twisted prism unit may be formed based on the tensegrity principle. Thus, a beam adapter with a tensegrity structure may be formed of m-strut twisted prism units. The 'm' is an integer greater than or equal to 6. In an example implementation, FIG. 9 illustrates a 10-strut twisted prism unit 900 based on the tensegrity principle. The 10-strut twisted prism unit 900 has a decagonal top surface and a decagonal bottom surface of decagonal structure. Further, the 10-strut twisted prism unit 900 has ten side faces that are planar polygons and have planes substantially perpendicular to the decagonal top surface and the decagonal bottom surface.

Referring to FIG. 7, the hexagonal top surface 710 and the hexagonal bottom surface 712 have congruent polygons. Further, the vertices of the hexagonal top surface 710 lie over the vertices of the bottom surface 712 after the rotation of the top surface 710 with respect to the bottom surface 712 by an angle of 120°. As a result, the side faces 714 are also congruent with each other. Further, the side faces 714 are formed as planar polygons with four vertices i.e. two vertices from the top surface 710 and two vertices from the bottom surface 712. The side face 714 of the beam adapter 700 is coupled to one of a first end or a second end of the beam 200, 300, 500, and 600 by the strut to strut connection.

Figure 10:
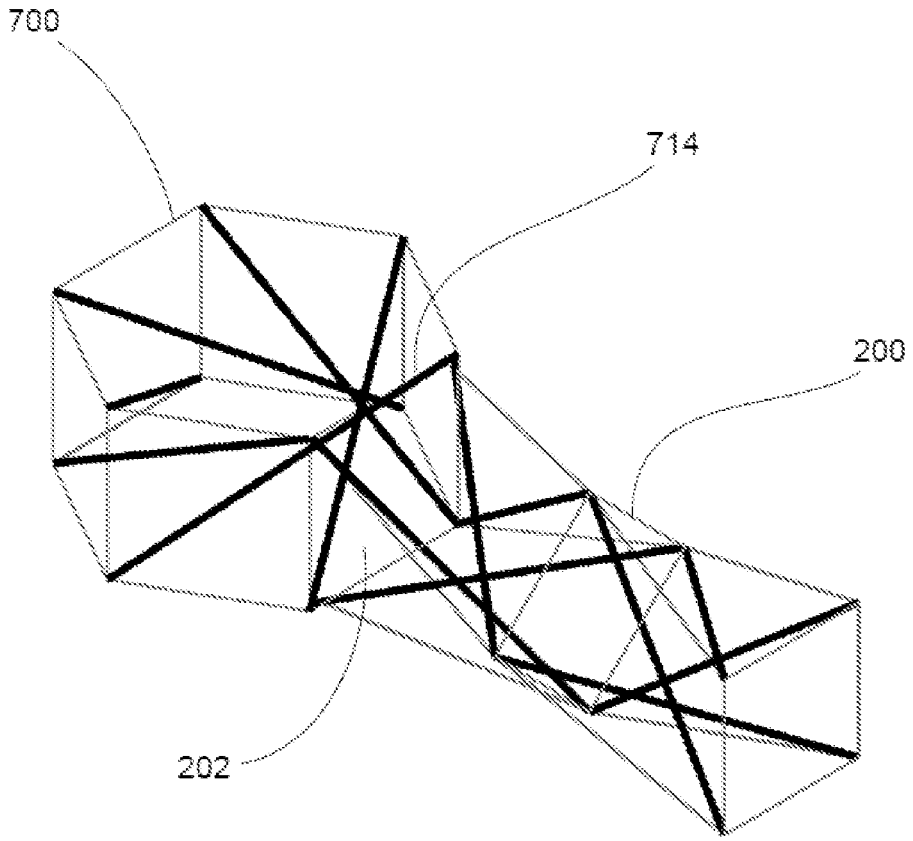
FIG. 10 illustrates a coupling of the 4-strut twisted prism unit and the 6-strut twisted prism unit, in accordance with an implementation of the present subject matter.

FIG. 10 illustrates a coupling of the 4-strut twisted prism unit and the 6-strut twisted prism unit 700, in accordance with an implementation of the present subject matter. Referring to FIG. 10, the first end 202 of the beam 200 has a 4-sided planar polygonal surface coupled to one of the side faces 714 of the beam adapter 700. The 4-sided planar polygonal surface at the first end 202 is congruent to the planar polygons formed by the side face 714 of the beam adapter 700, i.e. the length of edges of the 4-sided planar polygonal surface of the first end 202 of the beam 200 are equal to the length of edges of planar polygon formed at the side faces 714.

Figure 11:
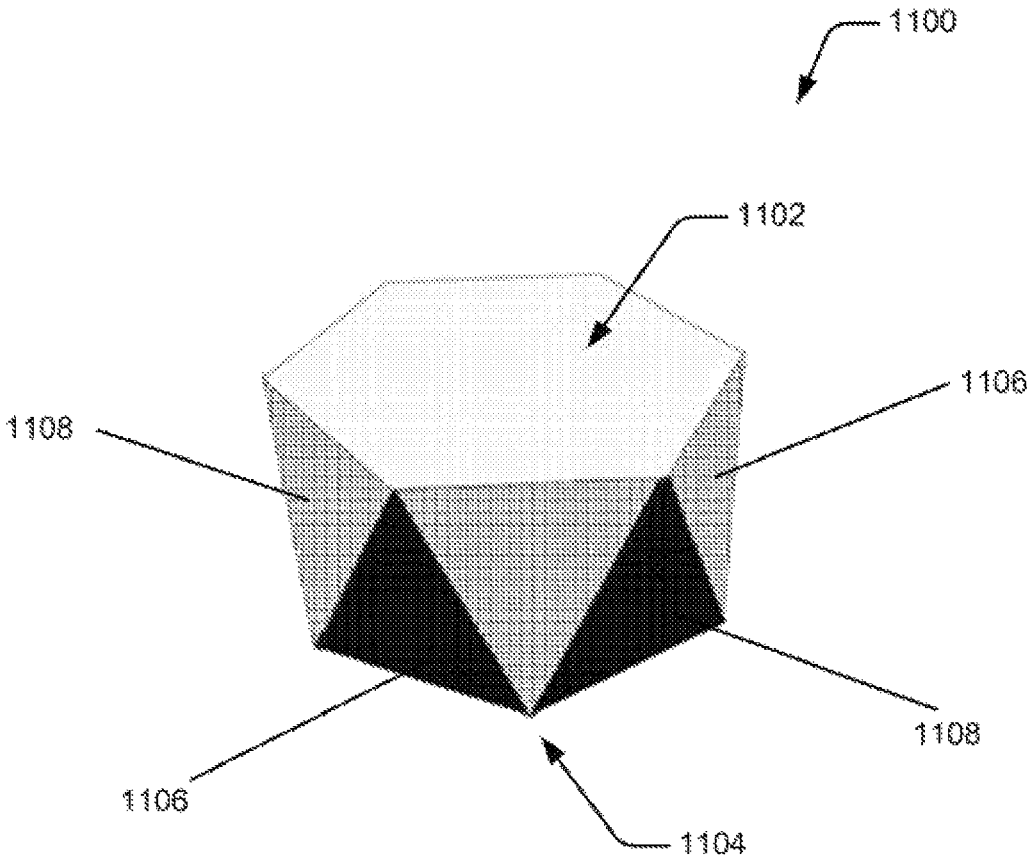
FIG. 11 illustrates an antiprism based on the tensegrity principle, in accordance with an implementation of the present subject matter.

FIG. 11 illustrates an antiprism 1100 based on the tensegrity principle, in accordance with an implementation of the present subject matter. The antiprism 1100 is an example implementation of the beam adapter. The antiprism 1100 is a 6-strut twisted prism unit having length of edges of a hexagonal top surface 1102 smaller the length of edges of a hexagonal bottom surface 1104. Further, the hexagonal top surface 1102 is rotated with respect to the hexagonal bottom surface 1104, such that, the side faces are obtained to include an alternately aligned a first set of polygons 1106 and a second set of polygons 1108. Here, the first set of polygons and the second set of polygons are triangles. Further, the hexagonal top surface 1102 is offset from the hexagonal bottom surface 1104, such that, a plane formed by each of the vertices of the hexagonal top surface 1102 with an edges of the hexagonal bottom surface 1104 below the respective vertex of the hexagonal top surface 1102 is substantially perpendicular to the planes of the hexagonal top surface 1102 and the hexagonal bottom surface 1104. As a result, the first set of polygon 1106 have planes substantially perpendicular to the planes of the hexagonal top surface 1102 and the hexagonal bottom surface 1104. Further, normal to the planes of the first set of polygon 1106 lie in a same plate. As shown in FIG. 11, the first set of polygons 1106 have triangular shape. Therefore, the antiprism 1100 has three vertices available for coupling with a beam. Thus, the antiprism 1100 is coupled to the beams 400 obtained by coupling plurality of 3-strut twisted prism units.

A VLFS obtained by the combination of beams 200, 300, 400, 500, and 600 and the beam adapter 700, 1100 has a stable structure when the components of the VLFS lie in the same plane. Any external environmental force exerting pressure on the VLFS will be effectively distributed in the VLFS when the whole structure lies in a same plane.

In an example implementation, the beam adapter, such as, the 6-strut twisted prism unit 802 in FIG. 8 has a stable structure with side faces having planes not perpendicular to the hexagonal top surface and the hexagonal bottom surface. Further, the side faces are formed in a shape of a folded polygon. A sub adapter with a combination of variable length struts may be arranged at the side faces formed as folded polygons to obtain extended side faces of planar polygons, such that, the extended side faces are substantially perpendicular to a hexagonal top surface and a hexagonal bottom surface of the 6-strut twisted prism unit 802. The sub adapter may be p-strut tensegrity module having a structure of a twisted prism unit. Alternatively referred to as p-strut twisted prism unit hereinafter.

Figure 12A:
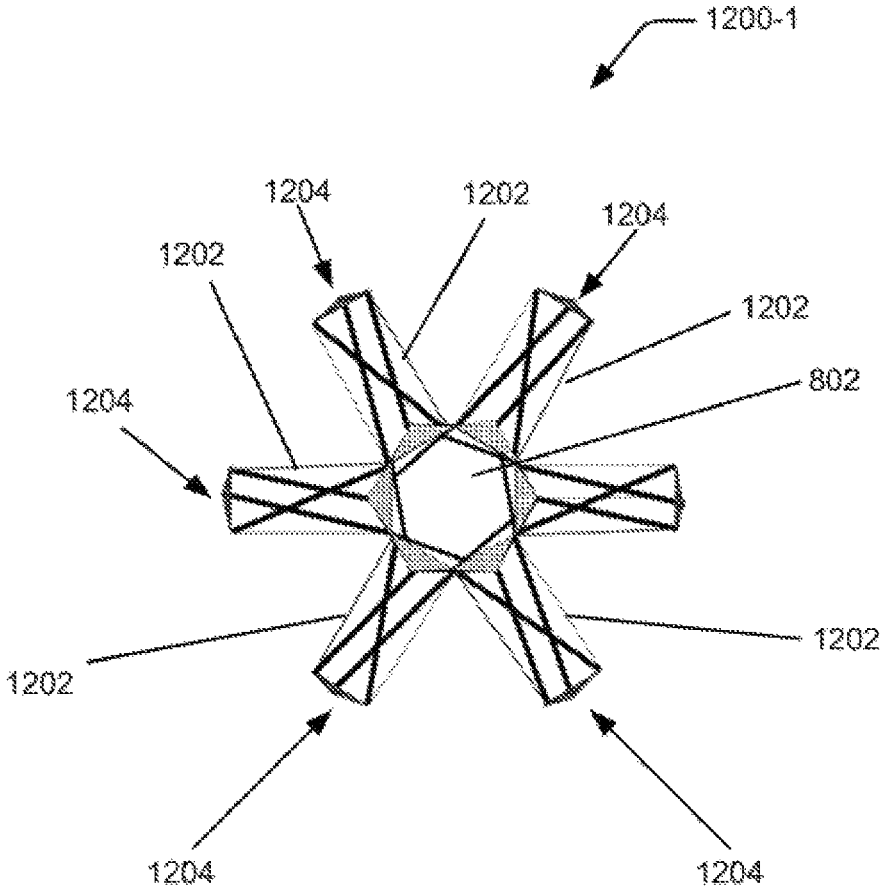
FIG. 12(*a*) illustrates a 6-strut twisted prism unit with extended side faces, in accordance with an implementation of the present subject matter.
Figure 12B:
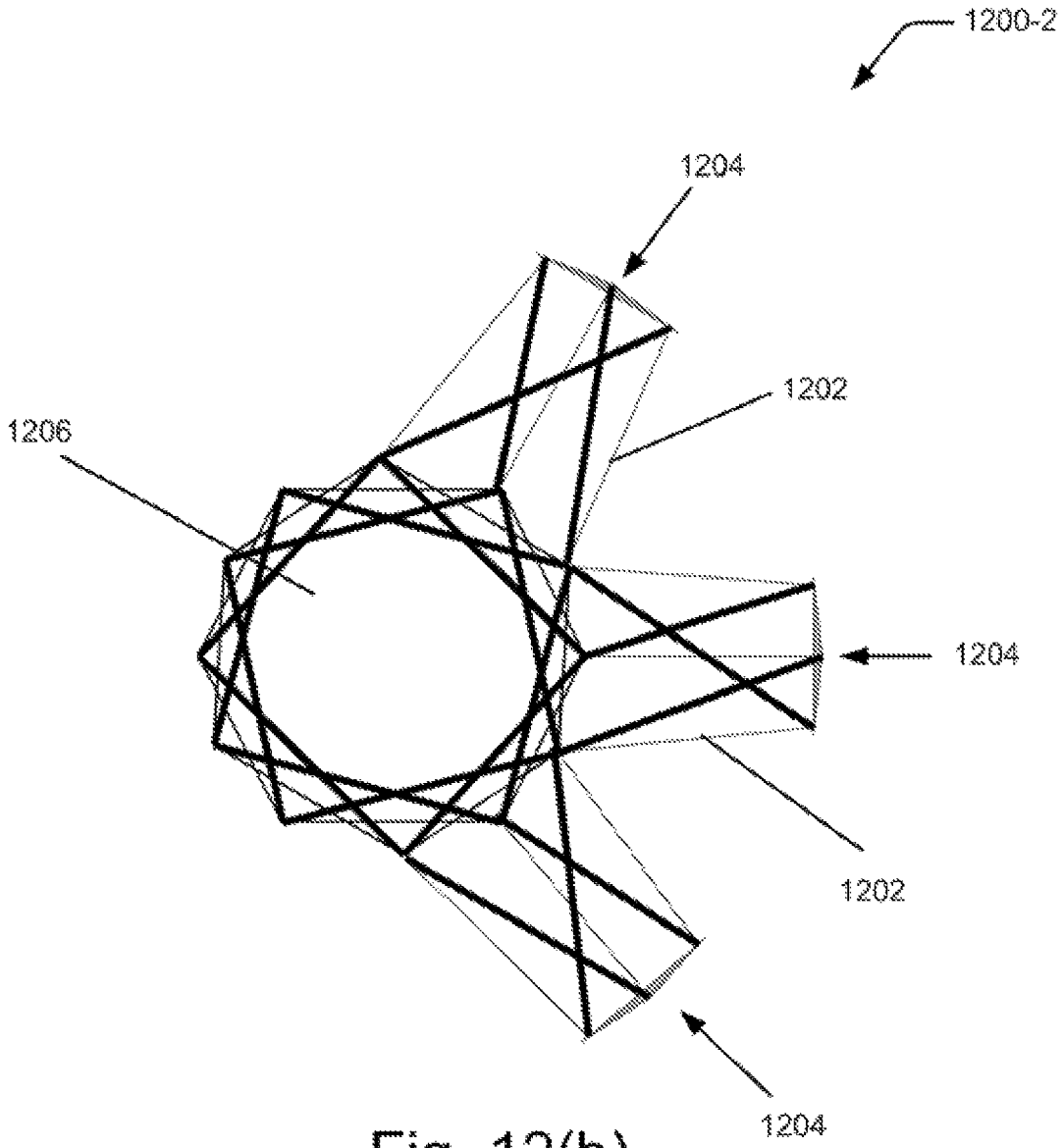

FIG. 12(*a*) illustrates a beam adapter 1200-1 having the 6-strut twisted prism unit 802 with extended planar side faces, in accordance with an implementation of the present subject matter. Vertices of each of side faces formed as folded polygons of the 6-strut twisted prism unit 802 are coupled to a p-strut twisted prism unit 1202, p is equal to the number of vertices in each of the side faces of the m-strut twisted prism unit. In the exemplary implementation, value of p is three. Thus, the 3-strut twisted prism unit has a 3-sided planar polygonal surface 1204, i.e. triangular surface, perpendicular to the m-sided polygonal top surface and the m-sided polygonal bottom surface.

The 3-strut twisted prism unit 1202 unit has three struts of variable lengths, ends of the struts of the 3-strut twisted prism unit form vertices of the 3-sided planar polygonal surface and vertices of 3-sided folded polygonal surface of the 3-strut twisted prism unit. The 3-sided planar polygonal surface is coupled to an n-sided polygonal surface of the beam 400. Further, the 3-sided folded polygonal surface is in symmetry with the side faces formed as folded polygon of the 6-strut twisted prism unit 802 and vertices of the 3-sided folded polygonal surface is coupled to the vertices of one of the side faces formed as folded polygons the 6-strut twisted prism unit 802.

FIG. 12(*b*) illustrates a beam adapter 1200-2 having a 12-strut twisted prism unit 1206 with extended planar side faces, in accordance with an implementation of the present subject matter. As shown in FIG. 12(*b*), vertices of each of the side faces formed as folded polygons of the 12-strut twisted prism unit 1206 are coupled to a p-strut twisted prism unit 1202. Here, value of p is three. Therefore, a sub adapter is formed from a 3-strut twisted prism unit 1202 with struts having variable length. The 3-strut twisted prism unit 1202 has a 3-sided planar polygonal surface 1204 perpendicular to a 12-sided polygonal top surface and a 12-sided polygonal bottom surface of the 12-strut twisted prism unit 1206. Further, the 3-strut twisted prism unit 1202 has a 3-sided folded polygonal surface coupled to a side face of the 12-strut twisted prism unit.

In an example implementation, a side face formed as folded polygon of a beam adapter may have four vertices, the sub adapter is formed from a 4-strut twisted prism unit to obtain an extended planar side face over the side face formed as folded polygon with four vertices. Here, value of p is four. The sub adapter 1202 may utilize more than three struts of uniform or variable length to provide planar side faces to a beam adapter.

The sub adapter may be coupled to an m-strut twisted prism having length of edges of an m-sided polygonal top surface unequal to length of edges an m-sided polygonal bottom surface and the side faces have plane not perpendicular to the m-sided polygonal top surface and the m-sided polygonal bottom surface. The sub adapter may provide extended planar polygonal sided face that are perpendicular to the m-sided polygonal top surface and the m-sided polygonal bottom surface of the m-strut twisted prism.

Figure 13:
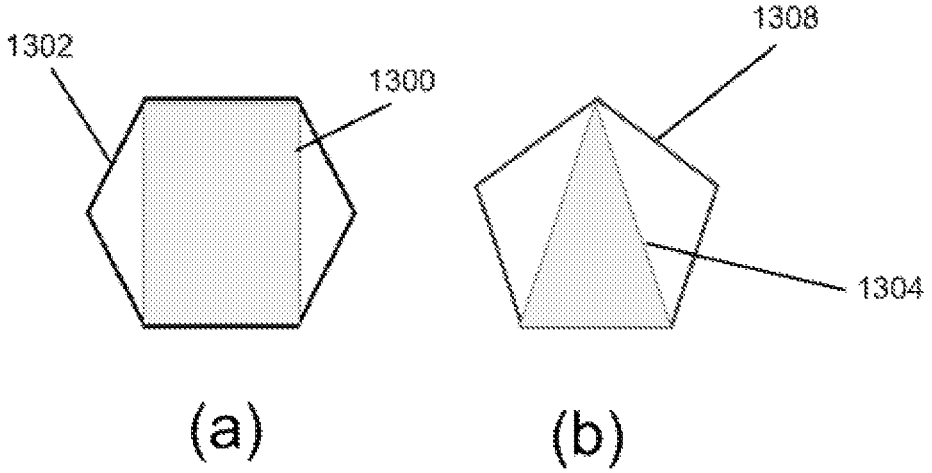
FIG. 13 illustrates common vertices for coupling a tensegrity beam and a beam adapter, in accordance with an implementation of the present subject matter.

For coupling a beam formed from n-strut twisted prism units and a beam adapter formed of m-strut twisted prism unit or formed of m-strut twisted prism unit with extended side faces, the n-sided planar polygonal surface formed at the first end or at the second end of the beam and the planar polygon formed at the side faces of the beam adapter shall have at least three common vertices for stable coupling. FIG. 13 illustrates common vertices for coupling the beam and the beam adapter, in accordance with an implementation of the present subject matter. Referring to FIG. 13(*a*), a side face 1300 of the m-strut twisted prism unit as a beam adapter has four vertices. A beam obtained from multiple 6-strut twisted prism units, i.e. value of n is six, has a first end 1302 formed in a shape of planar hexagonal and has six vertices. As shown in FIG. 13(*a*), the side face 1300 of the m-strut twisted prism unit and the first end 1302 of the beam have four common vertices for making the strut to strut connection Similarly, referring to FIG. 13(*b*), a side face 1304 of the m-strut twisted prism unit as a beam adapter has three vertices. A first end 1308 of a beam based on the 5-strut twisted prism unit has five vertices. As shown in FIG. 13(*b*), the side face 1304 of the m-strut twisted prism unit and the first end 1308 of the beam have three common vertices for making the strut to strut connection.

Figure 14:
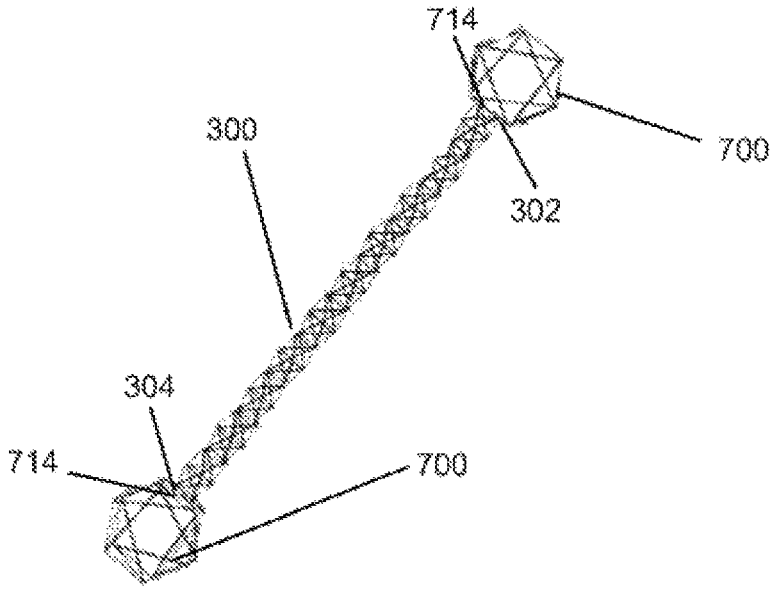
FIG. 14 illustrates a basic structural unit of a modular VLFS, in accordance with an implementation of the present subject matter.

In an implementation, the basic units for constructing the modular VLFS are the tensegrity beam and the beam adapters. FIG. 14 illustrates a basic structural unit of the modular VLFS, in accordance with an implementation of the present subject matter. Referring to FIG. 7, the beam adapter 700 offers planar surfaces on all sides to which the tensegrity beams 200, 300, 400, 500, and 600 can be joined. Also, the beam adapter 700 has six side faces 714 each of which is rectangular in shape. Referring to FIG. 3, the beam 300 has two rectangular shaped planar faces at the first end 302 and at the second end 304. Therefore, the beam 300 and the beam adapter 700 can be joined together, by attaching a rectangular planar end of the beam 300 with a rectangular side face of the beam adapter 700. Referring to FIG. 14, the beam adapter 700 and the tensegrity beam 300 are attached following the above mentioned methodology such that the first face 302 of the tensegrity beam 300 and the side face 714 of the beam adapter 700 intersect Similarly, the second face 304 of the tensegrity beam 300 and the side face 714 of another beam adapter 700 intersect.

Figure 15:
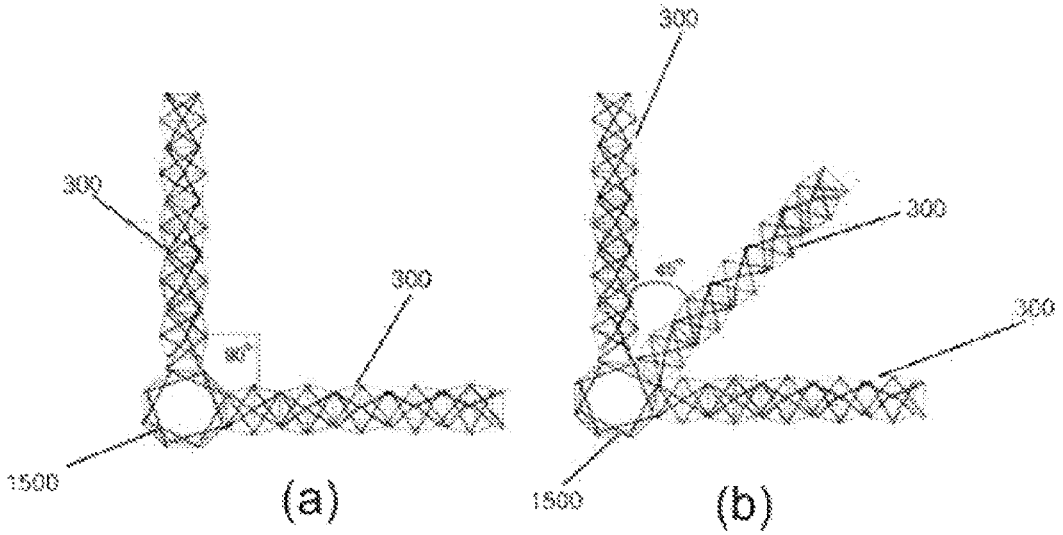
FIG. 15 illustrates arrangement of tensegrity beams, in accordance with an implementation of the present subject matter.

Further, multiple beams may be coupled to different side faces of a beam adapter at various inclinations to obtain different geometries of the closed loop structure. FIG. 15(*a*) illustrates tensegrity beams 300 arranged in the same plate and are inclined substantially perpendicular to each other, in accordance with an implementation of the present subject matter. Referring to FIG. 15(*a*), to obtain an angle of 90° between the beams 300, the beam adapter 1500 is obtained from an 8-strut twisted prism unit, i.e. value of m is 8. The 8-strut twisted prism unit has eight side faces that enables beam alignment in multiples of 45°. FIG. 15(*b*) illustrates tensegrity beams arranged in the same plate and are inclined at 45° with respect to the adjacent beam, in accordance with an implementation of the present subject matter.

Figure 16:
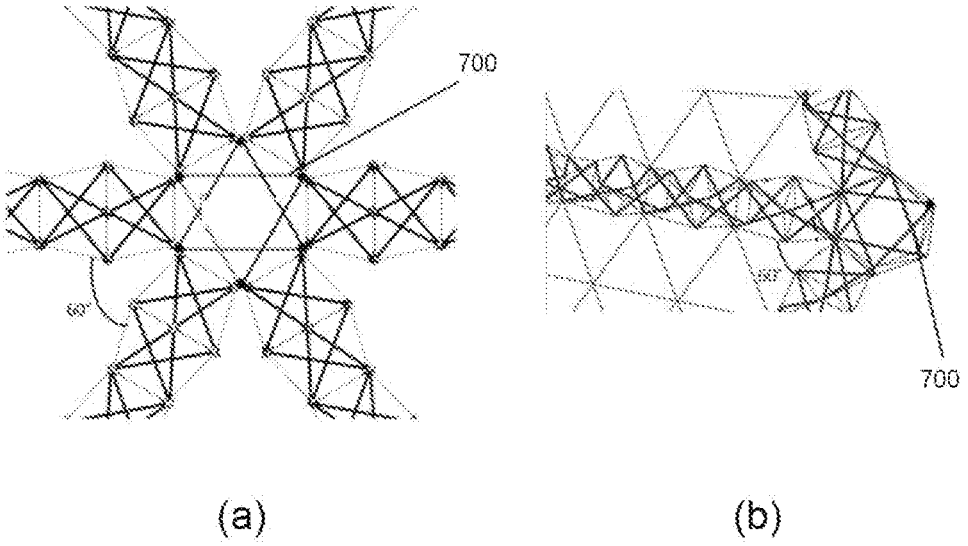
FIG. 16 illustrates arrangement of tensegrity beams, in accordance with an implementation of the present subject matter.

Similarly, the beam adapter 700 based on the 6-strut twisted prism unit has side faces that enables beam alignments in multiple of 60°. FIGS. 16(*a*) and 16(*b*) illustrate tensegrity beams arranged in the same plate and are inclined at 60° with respect to the adjacent beams, in accordance with an implementation of the present subject matter.

Figure 17:
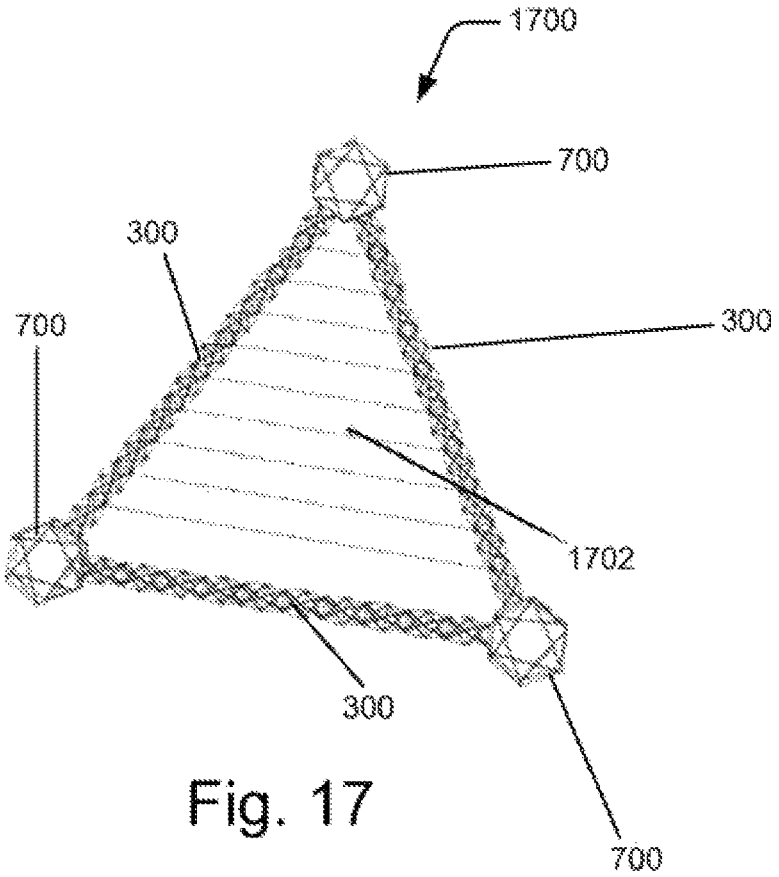
FIG. 17, FIG. 18, and FIG. 19 illustrate a basic structure of the modular VLFS, in accordance with an implementation of the present subject matter.
Figure 18:
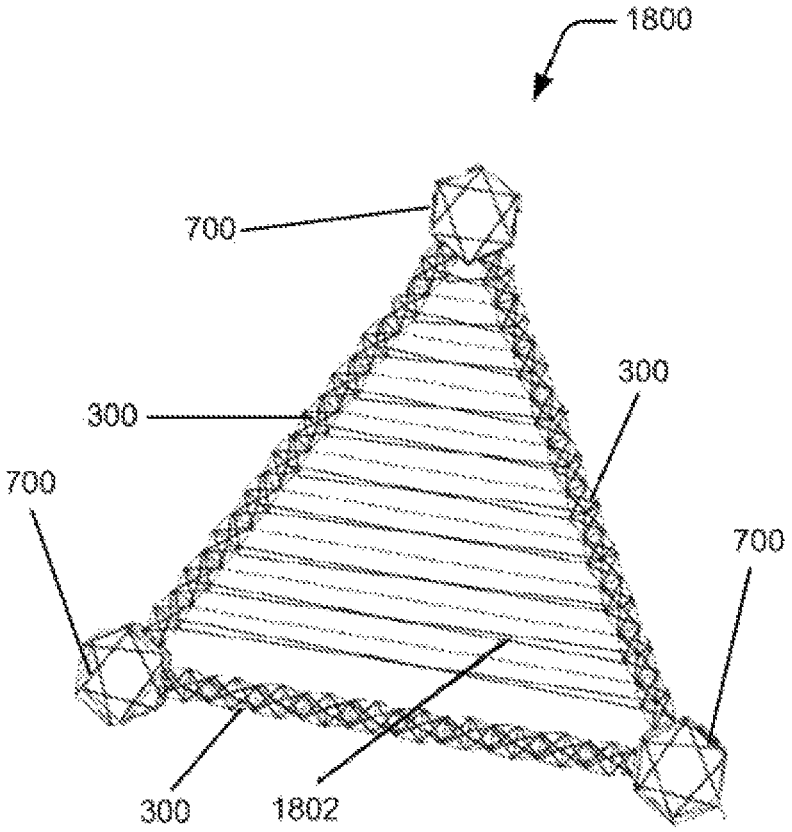
Figure 19:
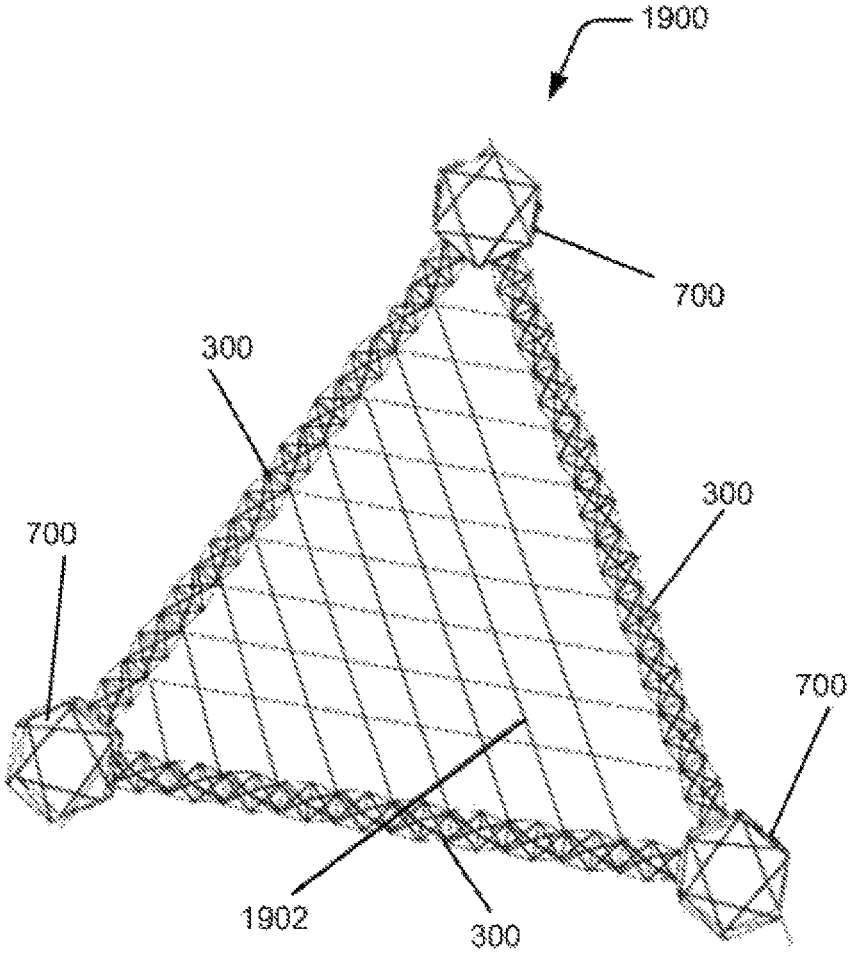
Figure 20:
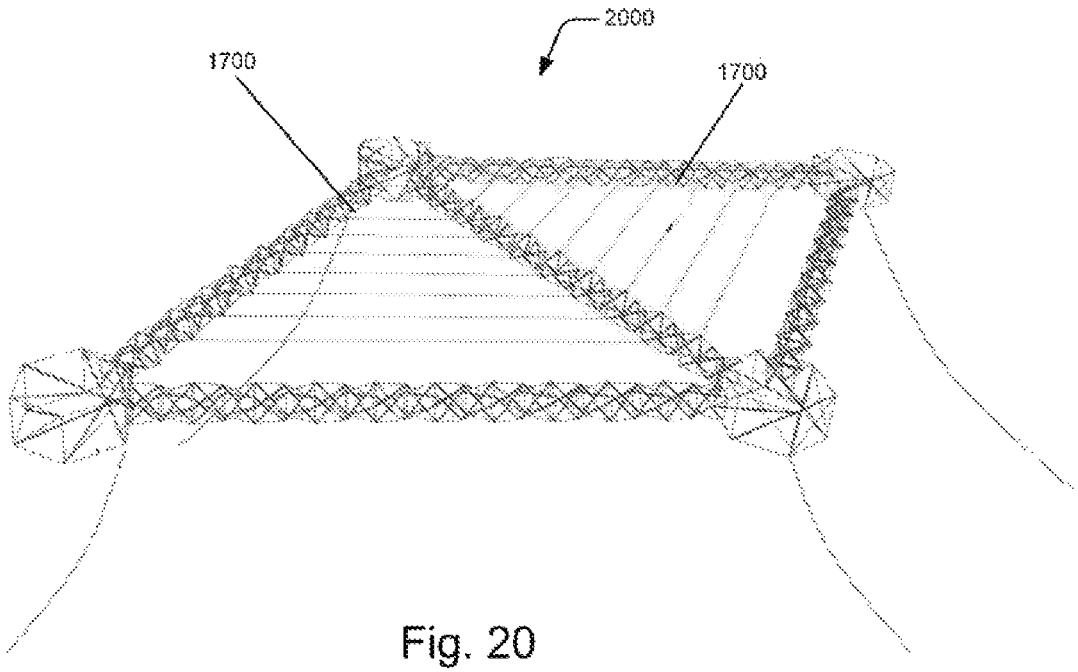
FIG. 20 illustrates a rhombus structure of the modular VLFS, in accordance with an implementation of the present subject matter.

Thus, multiple basic structural units, from FIGS. 14, 15 and 16, may be combined to obtained larger and usable structure units. FIG. 17 illustrates an equilateral triangle 1700 as a basic structure of the modular VLFS, in accordance with an implementation of the present subject matter. A combination of beam adapters obtained from the 6-strut tensegrity modules 700 and the beams 300 obtained from multiple 4-strut tensegrity modules may be used to build equilateral triangular structures which may function as a basic structure for the modular VLFS. The equilateral triangle 1700, 1800, and 1900, as illustrated in FIGS. 17, 18, and 19, may be utilized to build a basic structure for the modular VLFS of arbitrary shapes. For example, combining two such equilateral triangles 1700 and removing the duplicate diagonal i.e. beam 300 and the beam adapter 700 along the common diagonal forms a rhombus 2000, as illustrated in the FIG. 20. The 6-strut tensegrity modules act as a beam adapter where multiple tensegrity beams can connect. The basic structure in form of equilateral triangle, as described, may prevent the angular movement of the structure while floating in the ocean.

Further, FIGS. 17, 18, and 19 illustrate different weaving methods between any two adjacent tensegrity beams 300. The method of weave is used to connect the tensegrity beams that form the sides of the equilateral triangle 1700, 1800, and 1900. In particular, the weaving provides a crossbeam connection 1702, 1802, and 1902. More specifically, FIG. 17 illustrates only one set of ropes that connect two sides of the equilateral triangle 1700. FIG. 18 illustrates three sets of ropes that connect two sides of the equilateral triangle 1800. FIG. 19 illustrates two sets of ropes that connect two pairs of adjacent sides of the equilateral triangular 1900. The crossbeam connections 1702, 1802, and 1902 reinforce the structures interconnectivity. Different types of weaves have differing strengths and material requirement. The crossbeam integrates the entire structure and reduces the maximum load to a particular element of the structure undergoes. As a result, the overall material requirement of the tensegrity structure is reduced.

For weaving, each of a n-strut twisted prism unit of one beam is coupled to a corresponding n-strut twisted prism unit of another beam by one of a rope, a chain, and a cable.

As is described, the crossbeams as intricate connections within the tensegrity beams and across the tensegrity beams help in distributing the loads applied anywhere on the structure. The crossbeam and the tensegrity beams enable the structure to act in its entirety rather locally and may reduce the individual component's cost.

Figure 21:
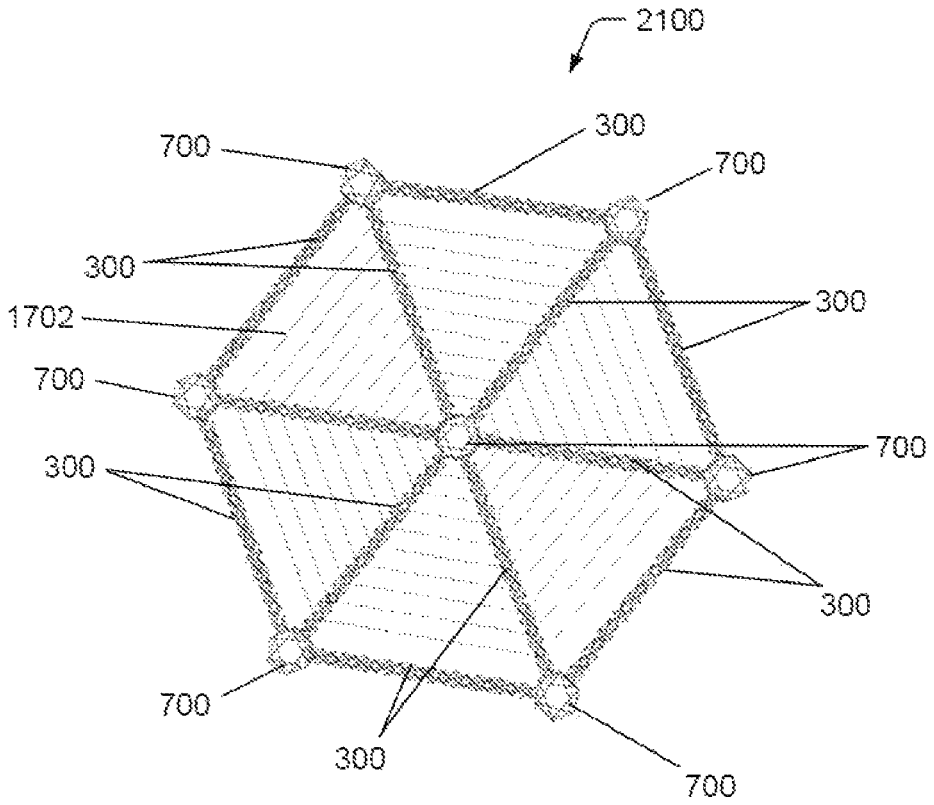
FIG. 21 and FIG. 22 illustrate a starfish structure of the modular VLFS, in accordance with an implementation of the present subject matter.
Figure 22:
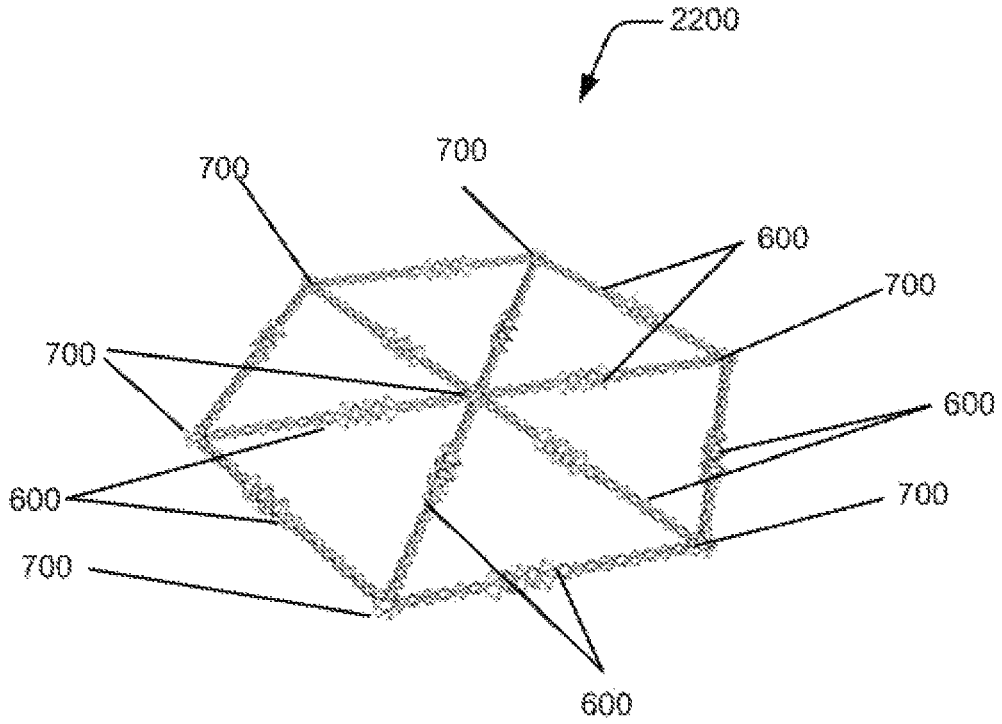

The basic structure of the VLFS unit may be utilized to generate various shapes. For example, FIG. 21 illustrates a modular VLFS having a starfish structure 2100 formed by joining the basic structure 1700, in accordance with an implementation of the present subject matter. A structure having a starfish like arrangement may be obtained by using twelve tensegrity beams 300 and seven beam adapters 700. FIG. 21 also illustrates the starfish structure has crossbeam connections between the tensegrity beams 300. FIG. 22 illustrates a modular VLFS having a starfish structure 2200 formed by joining the basic structure, in accordance with an implementation of the present subject matter. As shown in FIG. 22, a structure having a starfish like arrangement may be obtained by using twelve tensegrity non-uniform beams 600 and seven beam adapters 700.

Figure 23:
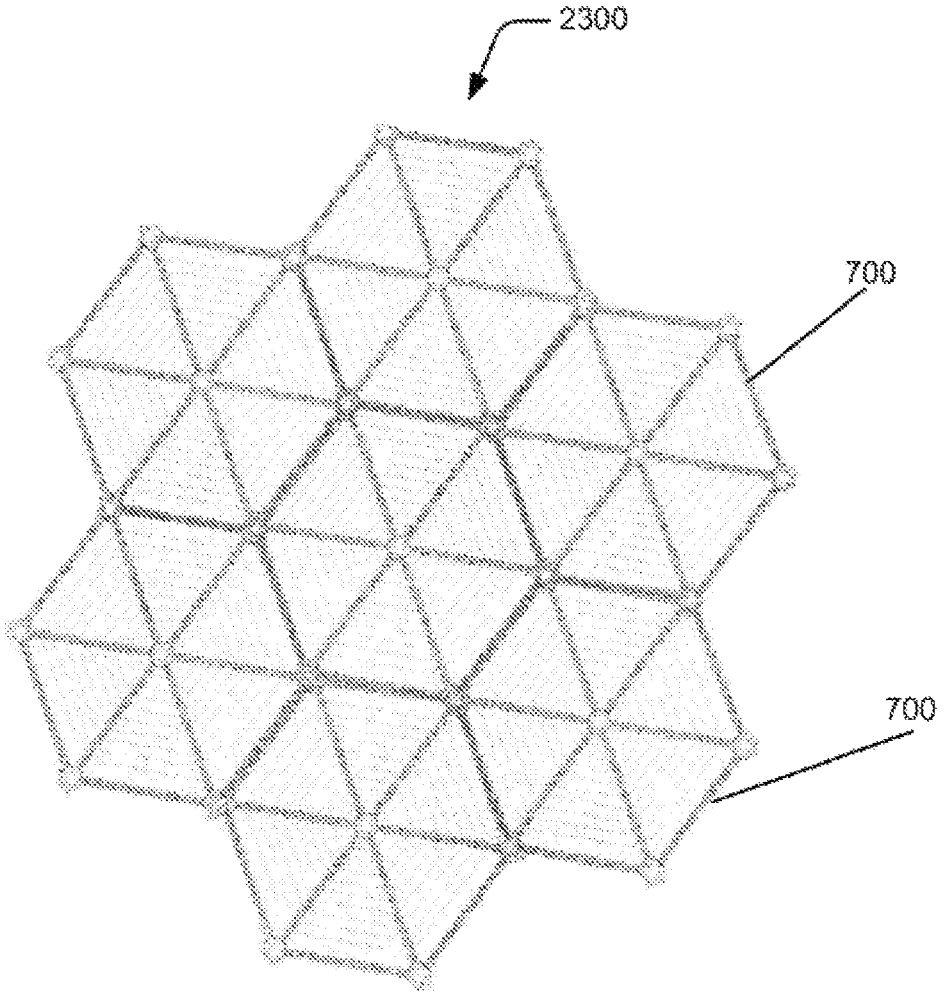
FIG. 23 illustrates a honeycomb structure of the modular VLFS, in accordance with an implementation of the present subject matter.

FIG. 23 illustrates a modular VLFS having a honeycomb structure formed by joining the basic structure, in accordance with an implementation of the present subject matter. As illustrated in FIG. 23, a honeycomb arrangement may be obtained by combining seven starfish structures 2100.

Figure 24:
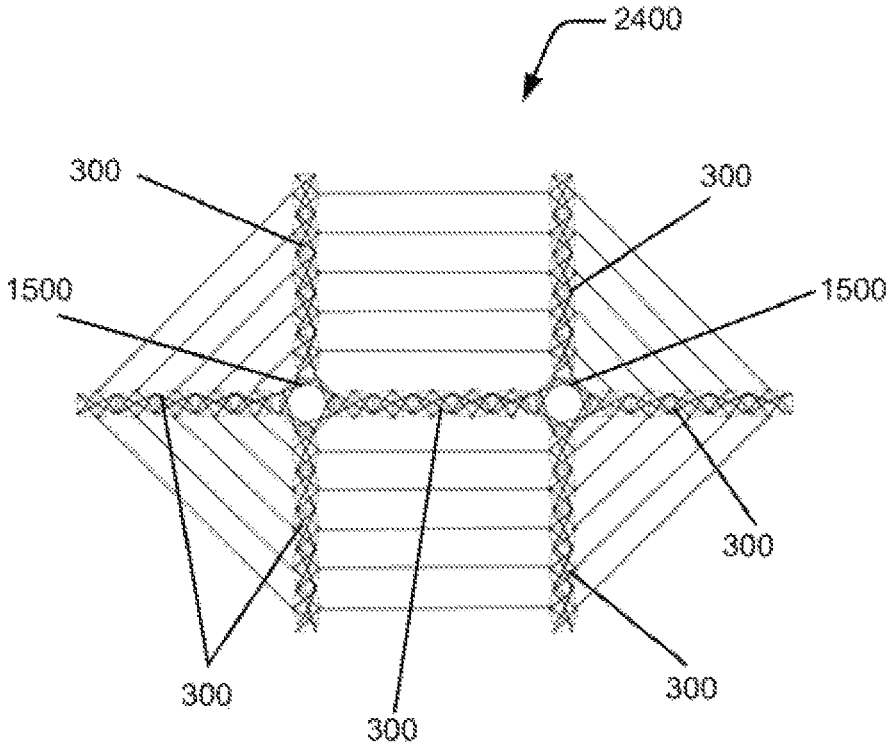
FIG. 24 illustrates a fish structure of the modular VLFS, in accordance with an implementation of the present subject matter.

FIG. 24 illustrates a modular VLFS having a fish like structure 2400 formed by joining the basic structure, in accordance with an implementation of the present subject matter. As illustrated in FIG. 24, a fish like arrangement may be obtained using seven tensegrity beams 300 and seven beam adapters 1500 based on 8-strut twisted prism unit. Further, as shown in FIG. 24, the crossbeams form edges of the fish like structure 2400 to form a closed loop structure. Similarly, the crossbeams 1702, 1802, and 1902 may formed as edges to form a closed loop structure in a modular VLFS.

Figure 25:
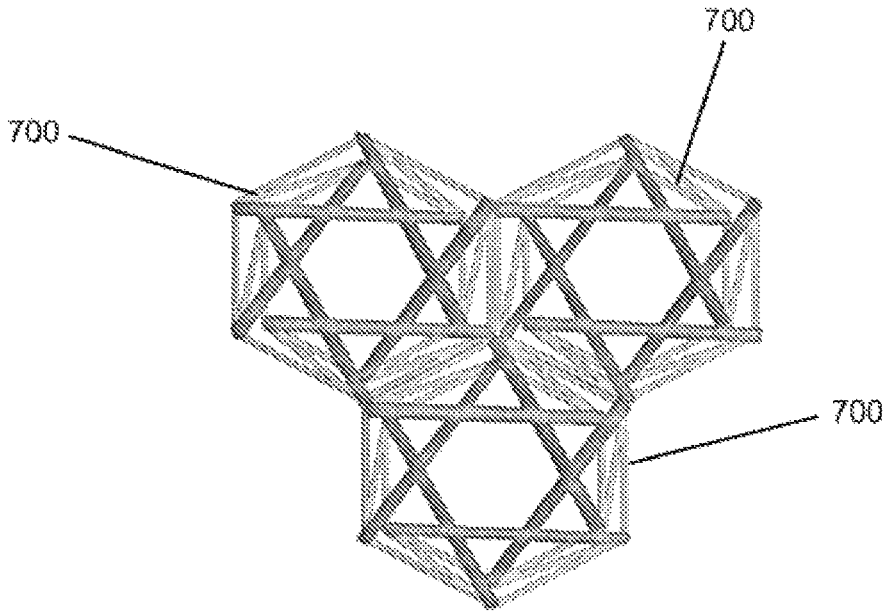
FIG. 25 illustrates an example structure of the modular VLFS, in accordance with an implementation of the present subject matter.

In an example implementation, a modular VLFS may be obtained by joining several 6-strut twisted prism units 700 to form a structure as well. As illustrated in FIG. 25, three 6-strut twisted prism units 700 are joined together to form a large tensegrity structure. Any two 6-strut twisted prism units 700 may be joined by attaching a side face 714 of a 6-strut twisted prism units 700 with a side face of another 6-strut twisted prism units 700.

Traditionally, there are two ways of joining the tensegrity modules to make a beam. One way of connecting the tensegrity structures ensures no two struts are in contact, called as pure tensegrity way of connection. This particular arrangement has very high flexibility. U.S. Pat. No. 6,901,714 uses this method of construction modules. Second way of connecting the tensegrity structures is by strut to strut connection.

However, the oceanic conditions under which the modular VLFS has to be functional, the structure is required to be flexible enough to adapt itself to the wave profile and undergoes lower stresses compared to a structure that is rigid. The tensegrity modules based on tensegrity principle provide such composure to the structures formed from tensegrity modules as described. Also, the structure is required to be rigid enough so that the structure will not undergo any major distortion when any portion of structure is subjected to a load.

Figure 26:
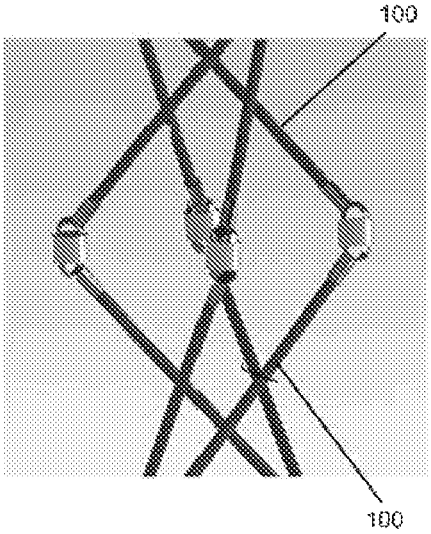
FIG. 26 and FIG. 27 illustrate a strut to strut connection using eyebolt and ring joint between two struts, in accordance with an implementation of the present subject matter.
Figure 27:
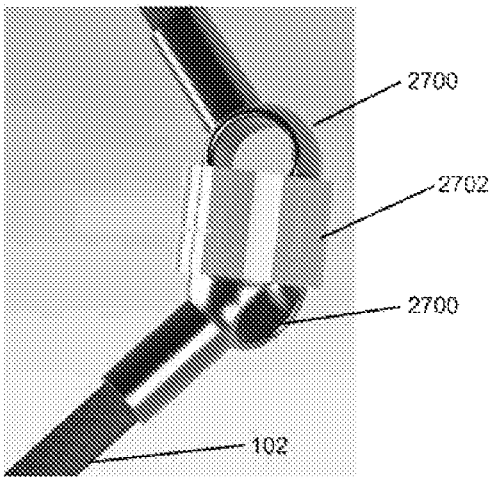

The structure having strut to strut connection is comparatively more rigid than the pure tensegrity method. FIG. 26 and FIG. 27 show a strut to strut connection using eyebolt and ring joint, in accordance with an implementation of the present subject matter. FIG. 26 and FIG. 27 illustrate ring joints for joining two 4-strut twisted prism unit 100 (for clarity pre-tensioned ropes are not shown). Each strut 102 is fitted with an eyebolt 2700. Every 4-strut twisted prism unit 100 has four convex surfaces at four vertices. Each 4-strut twisted prism unit 100 is attached to another 4-strut twisted prism unit 100 with a doubly concave part 2702 in between them. The two rings at ends of the eye bolt 2700 are then tied together using a rope or a screw. This arrangement ensures the flexibility of the tensegrity arrangement and at the same time the strength of the structure is not compromised. Further, the holes in the rings are utilized for tying the pre-tensioned ropes 104.

Figure 28:
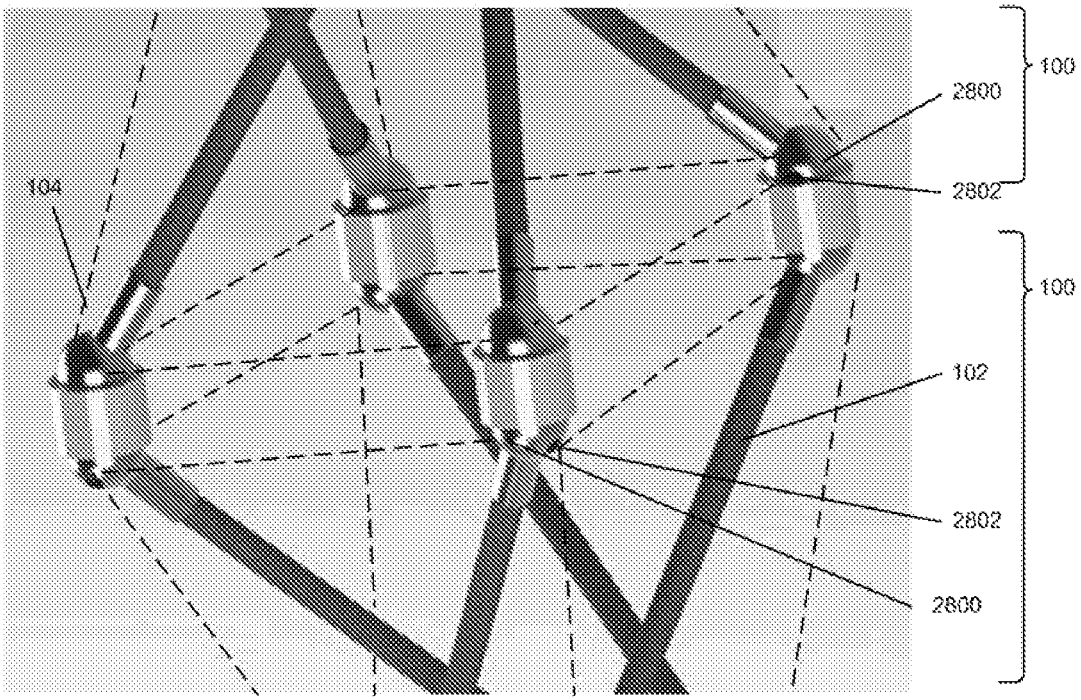
FIG. 28 illustrates a strut to strut connection using ball and ring, in accordance with an implementation of the present subject matter.

In an example implementation, ball arrangement is used for strut to strut connection. FIG. 28 shows a strut to strut connection using balls 2800, in accordance with an implementation of the present subject matter. FIG. 28 describes balls 2800 are connected to the struts 102, such that the two 4-strut twisted prism units 100 are connected to each other by placing a doubly concave part in between them. Further, the balls 2800 are provided with holes 2802 as means for tying the pre-tensioned ropes 104.

Figure 29:
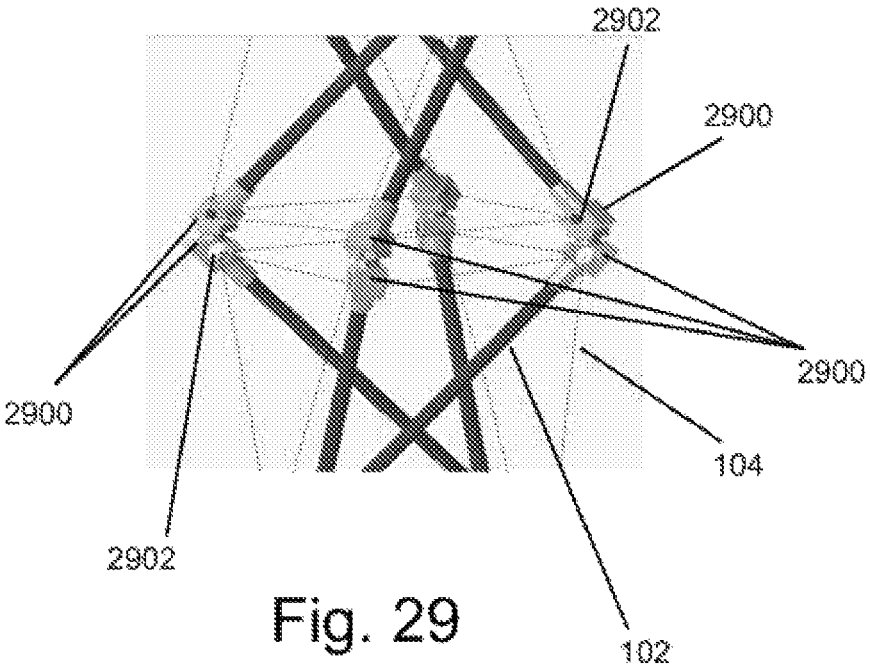
FIG. 29 illustrates a strut to strut connection using ball and socket arrangement, in accordance with an implementation of the present subject matter.

In an example implementation, a ball and socket arrangement is used for strut to strut connection. FIG. 29 shows a strut to strut connection using ball and socket arrangement, in accordance with an implementation of the present subject matter. FIG. 29 illustrates a 4-strut twisted prism unit 100 has four balls attached to the struts and another connecting 4-strut twisted prism unit 100 has four sockets 2900 attached to the struts 102. The two 4-strut twisted prism unit 100 are connected by placing the balls into the sockets 2900. Further, the sockets 2900 are provided with holes 2902 as means for tying the pre-tensioned ropes 104.

Figure 30:
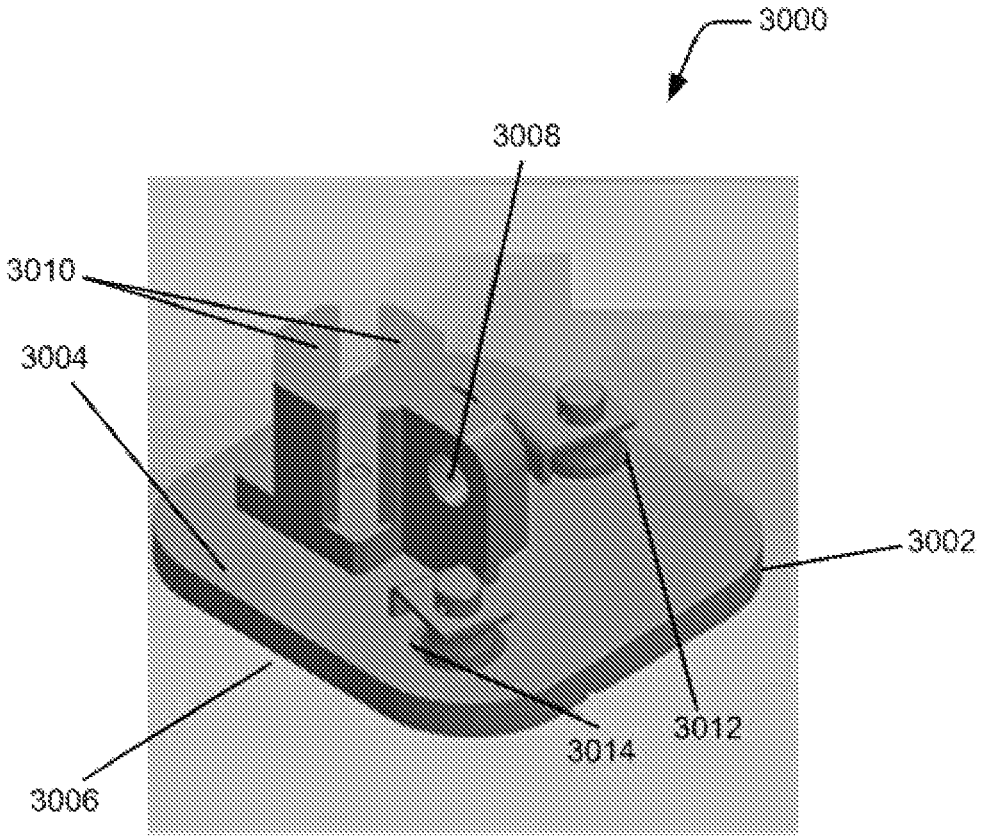
FIG. 30(*a*) and FIG. 30(*b*) illustrate a joint for a strut to strut connection, in accordance with an implementation of the present subject matter.
Figure 30:
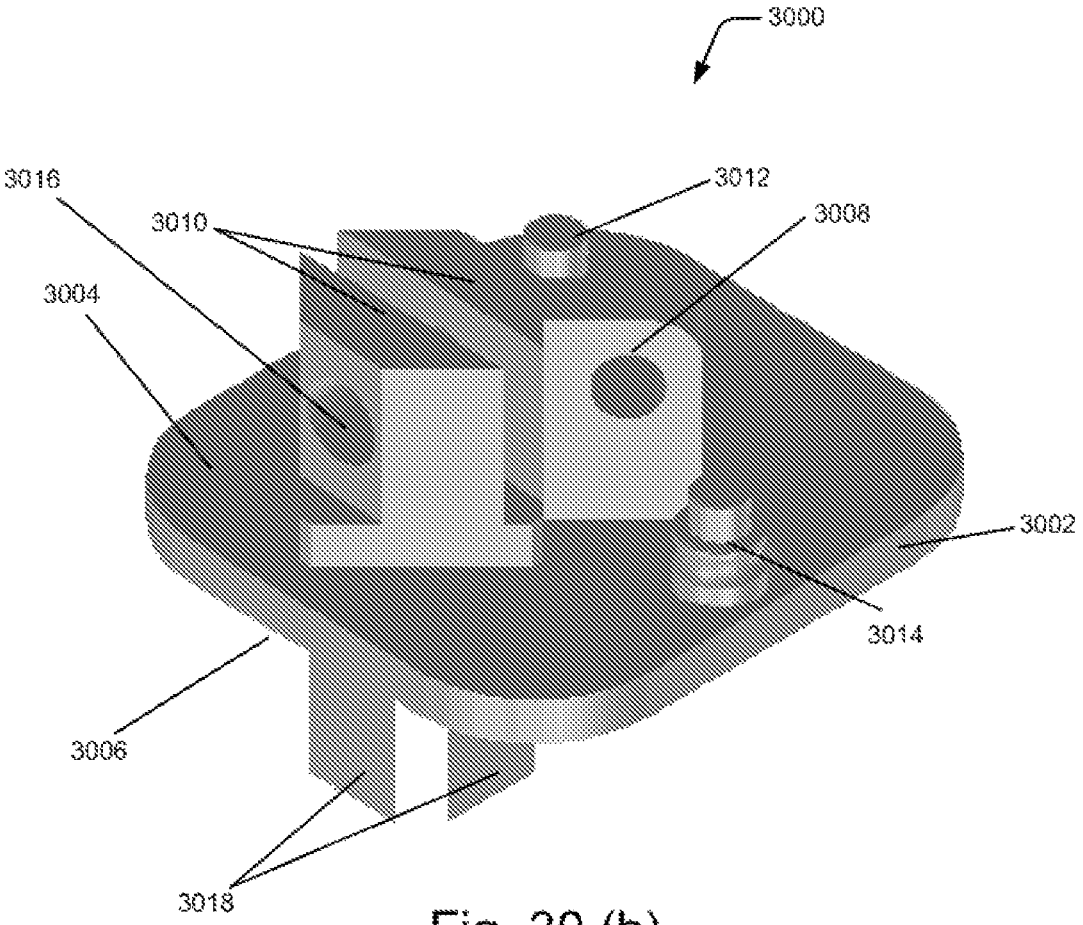

FIG. 30(*a*) and FIG. 30(*b*) illustrate a joint arrangement 3000 for a strut to strut connection for coupling two n-strut twisted prism units, in accordance with an implementation of the present subject matter. The common joint arrangement 3000 is implemented at the vertices of at least one of the n-sided planar polygonal surfaces of the n-strut twisted prism units of the beam 200, 300, 500, 600. The joint arrangement 3000 includes a base plate 3002. The base plate has a first planar side 3004 and a second planar side 3006. A first hinge 3008 is provided at a center of the first planar side 3004 for coupling one end of a strut of a n-strut twisted prism unit. A first pair of parallel plates 3010 with holes 3016 are provided at the first planar side 3004 for coupling a pre-tension rope of the n-strut twisted prism unit. Further, a first hook 3012 and a second hook 3014 are provided at the edges of the first planar side 3004 and at the either sides of the first hinge 3008 for coupling to the pre-tensioned ropes. Further, a second hinge (not visible), similar to the first hinge 3008, is provided at a center of the second planar side 3006 for coupling one end of a strut of another n-strut twisted prism unit. A second pair of parallel plates 3018, similar to the first pair of parallel plates 3010, with holes are provided at the second planar side 3006 for coupling a pre-tension rope of another n-strut twisted prism unit.

Figure 31:
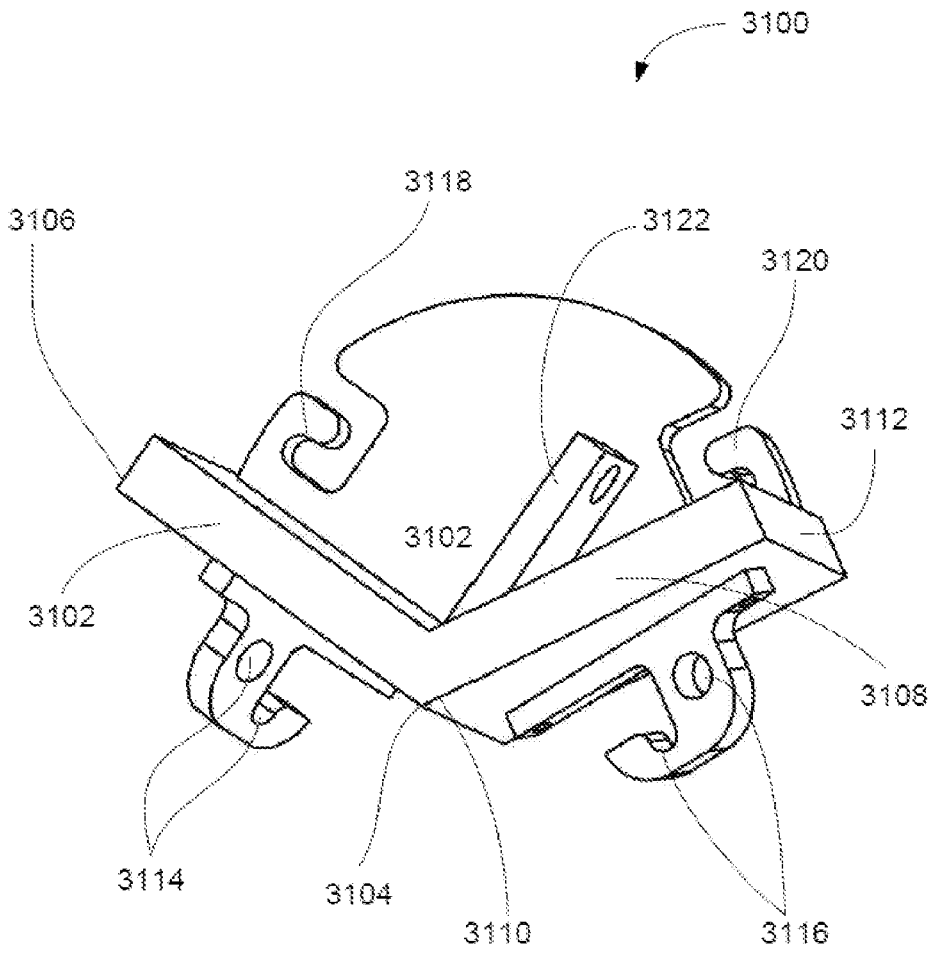
FIG. 31 illustrates a connector for a strut to strut connection, in accordance with an implementation of the present subject matter.

FIG. 31 illustrates a connector 3100 for strut to strut connection for coupling the m-strut twisted prism unit with the n-strut twisted prism unit, in accordance with an implementation of the present subject matter. The connector 3100 is implemented at the vertices of the m-sided polygonal top surface and the m-sided polygonal bottom surface of m-sided twisted prism unit of a beam adapter 700, 900, 1100, and 1200. The connector 3100 includes a first plate 3102 having a first end 3104 and a second end 3106. Further, the connector 3100 includes a second plate 3108 having a first end 3110 and a second end 3112. The first end 3110 of the second plate 3108 abuts with the first end 3104 of the first plate 3102, such that, the second plate 3108 is inclined at an obtuse angle with the first plate 3102. The inclined first plate 3102 and the second plate 3108 forms an outer face of a convex shape and an inner face of a concave shape. The alignment of the first plate 3102 with respect to the second plate 3108 may vary based on the configuration of the m-strut twisted prism unit.

Further, the connector 3100 includes a first integrated hinge-hook arrangement 3114 provided at the first plate 3102 and at the outer face for coupling to a strut and a pre-tensioned rope of a n-strut twisted prism unit. A second integrated hinge-hook arrangement 3116 is provided at the second plate 3108 and at the outer face for coupling to a strut and a pre-tensioned rope of another n-strut twisted prism unit. A first hook 3118 is provided towards the second end 3106 of the first plate 3102 and at the inner face for coupling to a pre-tensioned rope of a connector adjacent towards the first plate 3102. A second hook 3120 is provided towards the second end 3112 of the second plate 3108 and at the inner face for coupling to a pre-tensioned rope of a connector adjacent towards the second plate. Further, a hinge 3122 is provided between the first hook 3118 and the second hook 3120 and at the inner face for coupling one end of a strut of the m-strut twisted prism unit.

Referring to FIG. 10, the beam 200 is obtained by coupling multiple 4-strut twisted prism unit 100. Coupling of between the multiple 4-strut twisted prism unit 100 are implemented by the common joint arrangement 3000. Further, the beam adapter is the 6-strut twisted prism unit 700. The vertices at the hexagonal top surface and at the hexagonal bottom surface includes the connector 3100. As shown in FIG. 10, the connector 3100 enables a strut to strut coupling between the beam 200 and the beam adapter 700.

In an example implementation, buoys are attached to the modular

Figure 32:
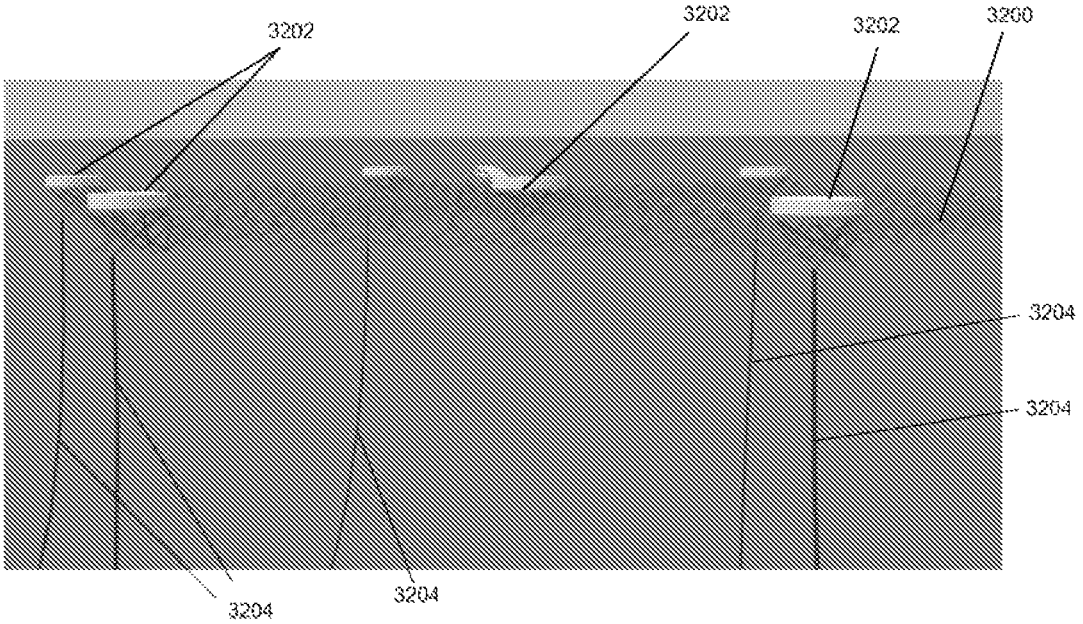
FIG. 32 illustrates buoys attached to the modular VLFS, in accordance with an implementation of the present subject matter.

VLFS to enable the modular VLFS either to float on water or float at submerged level in water. FIGS. 32 illustrates buoys 3202 attached to the modular VLFS 3200. The buoys may be coupled to the beam adapter or to the beam. The modular VLFS floats on water when buoys 3200 are attached beneath the structure. The modular VLFS floats at submerged level in water when buoys 3200 are attached over the structure. As shown in FIG. 32, the buoys 3202 are coupled over the beam adapter of the modular VLFS 3200. The modular VLFS 3200 floats at the submerged level in the water.

Further, anchors are also attached to the beam adaptors. The anchors are attached to the beam adapters either though cables, ropes or chains referenced as 3204 (as shown in FIG. 32).

In an example implementation, a pre-tensioned rope is made of a material having any one or in combination of metal, alloy, carbon, polymer, plastic, or fiber.

In an example implementation, a strut is made of a material having any one or in combination of metal, alloy, carbon, polymer, plastic, concrete, or fiber.

Figure 33:
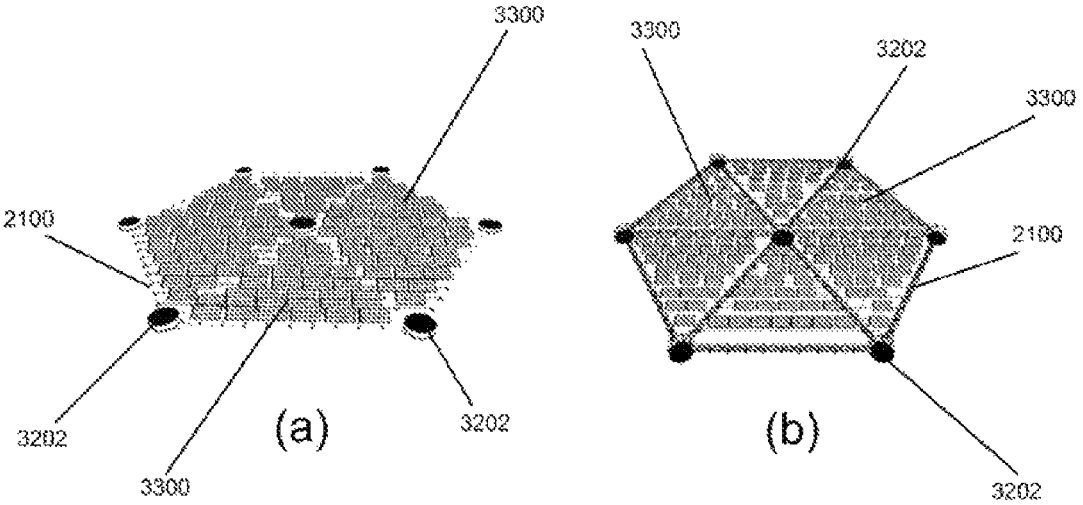
FIG. 33 and FIG. 34 illustrate an implementation of the modular VLFS, in accordance with an implementation of the present subject matter.
Figure 34:
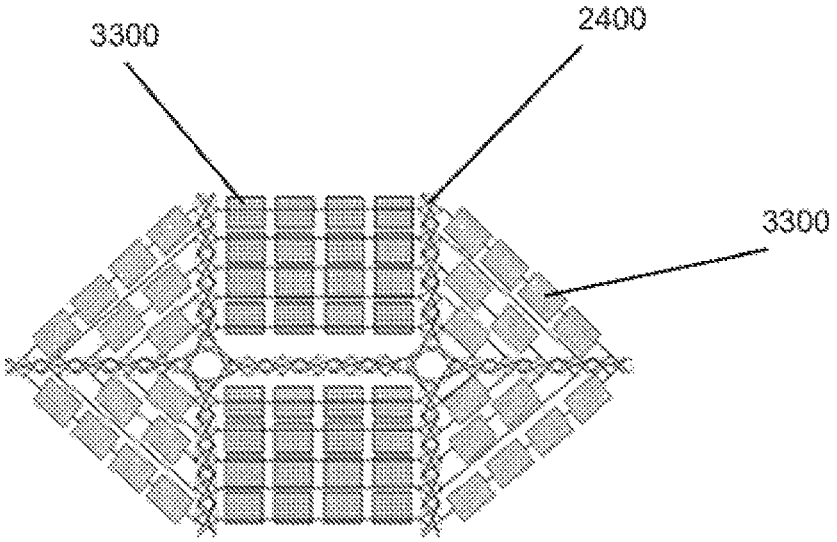

In an example implementation, the VLFS may be utilized for generating electricity from solar energy. FIGS. 33 and 34 illustrate a modular VLFS implemented to install solar panels 3300 on the water bed, in accordance with an implementation of the present subject matter. The VLFS is based on starfish like structure, as shown in FIG. 21. Referring to FIG. 33(*a*), buoys 3202 are attached over the beam adapters of the modular VLFS 2100. The structure of the modular VLFS 2100 is submerged in water and the solar panels 3300 are above water. Referring to FIG. 33(*b*), buoys 3202 are attached below the beam adapters of the modular VLFS 2100. The structure of the modular VLFS 2100 floats above the water. Referring to FIG. 34, the modular VLFS 2400 for installing solar panels 300 is based on fish like structure, as shown in FIG. 24.

In an example implementation, referring to FIG. 33 and FIG. 34, the buoys may be provided between the crossbeams formed by weaving two edge beams in a polygon. Thus, buoys provided between the crossbeams of the VLFS provide additional floating stability to the VLFS and also provide platform for installing solar panels 3300. The buoys may be integrated with, and form a part of the weaving cables itself. The buoys may also be placed at the intersection points of two or more cables, and may even act as the connector hub for these cables.

Although the subject matter has been described with reference to specific embodiments, this description is not meant to be construed in a limiting sense. Various modifications of the disclosed embodiments, as well as alternate embodiments of the subject matter, will become apparent to persons skilled in the art upon reference to the description of the subject matter. It is therefore contemplated that such modifications can be made without departing from the spirit or scope of the present subject matter as defined.

We claim:

1. A floating structure comprising a closed loop tensegrity structure (1700, 1800, 1900, 2100, 2200, 2300) including:

a plurality of beam adapters (700, 900, 1100, 1200, 1500), wherein each beam adapter of the plurality of beam adapters (700, 900, 1100, 1200, 1500) is an m-strut twisted prism unit (700), m is an integer greater than 4, wherein the m-strut twisted prism unit comprises:

m-sided planar polygonal top surface (710, 1102);

m-sided planar polygonal bottom surface (712, 1104), opposite to the m-sided planar polygonal top surface (710, 1102); and at least m number of side faces (714, 1106) formed as planar polygons; and a plurality of beams (200, 300, 400, 500, 600), wherein each beam of the plurality of beams (200, 300, 400, 500, 600) is formed by coupling multiple n-strut twisted prism units (100), n is an integer greater than 2, wherein each of the multiple n-strut twisted prism units includes n-sided planar polygonal surfaces (106, 108) on opposite sides through which the respective n-strut twisted prism unit is coupled to another n-strut twisted prism unit or a beam adapter of the plurality of beam adapters (700, 900, 1100, 1200, 1500);

wherein the m-strut twisted prism unit (700, 900, 1100, 1200, 1500) has m number of struts (702) arranged to form the m-strut twisted prism unit (700, 900, 1100, 1200, 1500), ends of the struts (702) form vertices of the m-sided polygonal top surface (710, 1102), vertices of the m-sided polygonal bottom surface (712, 1104), and vertices of the at least m number of side faces (714, 1108), and wherein pre-tensioned ropes (704) attached to ends of adjacent struts (702) form edges of the m-sided polygonal top surface (710, 1102) and the m-sided polygonal bottom surface (712, 1104), and wherein an n-sided planar polygonal surface (202, 302, 402, 502) of a beam of the plurality of beams (200, 300, 400, 500, 600) is coupled to a side face of a beam adaptor of the plurality of beam adaptors (700, 900, 1100, 1200, 1500).

2. The floating structure as claimed in claim 1, wherein length of edges of an n-sided planar polygonal surface (106) of each of the n-strut twisted prism unit (100) are equal to length of edges of another n-sided planar polygonal surface (108) on opposite side of the respective n-strut twisted prism unit (100).

3. The floating structure as claimed in claim 1, wherein length of edges of an n-sided planar polygonal surface of each of the n-strut twisted prism unit (602) are smaller than length of edges of another n-sided planar polygonal surface on opposite side of the respective n-strut twisted prism unit (602).

4. The floating structure as claimed in claim 3, wherein two n-strut twisted prism units (602, 604) of the multiple n-strut twisted prism units are coupled by respective n-sided planar polygonal surfaces having edges of equal length.

5. The floating structure as claimed in claim 1, wherein length of edges of the m-sided planar polygonal top surface (710) are equal to length of edges of the m-sided planar polygonal bottom surface (712) in the m-strut twisted prism unit (700).

6. The floating structure as claimed in claim 1, wherein length of edges of the m-sided planar polygonal top surface (1102) are smaller than length of edges of the m-sided planar polygonal bottom surface (1106) in the m-strut twisted prism unit (1100), and wherein the m-sided planar polygonal top surface (1102) is offset from the m-sided planar polygonal bottom surface (1104), such that a plane formed by each vertex of the m-sided planar polygonal top surface (1102) with an edge of the m-sided planar polygonal bottom surface (1104) below the respective vertex of the m-sided planar polygonal top surface (1102) is perpendicular to the m-sided planar polygonal top surface (1102) and to the plane m-sided planar polygonal bottom surface (1104).

7. The floating structure as claimed in claim 1, wherein the at least m number of side faces (714) are substantially perpendicular to the m-sided planar polygonal top surface (710) and the m-sided planar polygonal bottom surface (712) of the m-strut twisted prism unit (700).

8. The floating structure as claimed in claim 1, wherein each of the multiple n-strut twisted prism units (100) has n number of struts (102) arranged to form the respective n-strut twisted prism unit (100), wherein ends of the struts (102) of a respective n-strut twisted prism unit (100) form vertices of the n-sided planar polygonal surface (106, 108), and wherein pre-tensioned ropes (104) attached to ends of adjacent struts (102) form edges of the n-sided planar polygonal surface (106, 108).

9. The floating structure as claimed in claim 8, wherein vertices of respective n-sided planar polygonal surface (106, 108) of an n-strut twisted prism unit (100) of the multiple n-strut twisted prism units (100) are coupled to vertices of respective n-sided planar polygonal surface of another n-strut twisted prism unit of the multiple n-strut twisted prism units (100).

10. The floating structure as claimed in claim 9, wherein the vertices of n-sided planar polygonal surfaces (106, 108) are coupled by joints selected from one of a ring joint (2700), a ball joint (2800), and a ball-socket joint (2900).

11. The floating structure as claimed in claim 8, wherein each of the vertices of an n-sided planar polygonal surface of the n-sided planar polygonal surfaces (106, 108) comprises:

a base plate (3002) including:

a first planar side (3004), wherein the first planar side (3004) comprises:

a first hinge (3008) provided at a center of the first planar side (3004) for coupling one end of a strut of the respective n-strut twisted prism unit;

a first pair of parallel plate (3010) with holes (3016) provided at the first planar side (3004) for coupling to a pre-tension rope of the respective n-strut twisted prism unit; and a first hook (3012) and a second hook (3014) provided at the edges of the first planar side (3004) and at the either sides of the first hinge (3008) for coupling to the other pre-tensioned ropes of the respective n-strut twisted prism unit; and a second planar side (3006), wherein the second planar side (3006) comprises:

a second hinge provided at a center of the second planar side for coupling one end of a strut of another n-strut twisted prism unit; and a second pair of parallel plate (3018) with holes provided at the second planar side for coupling a pre-tension rope of another n-strut twisted prism unit.

12. The floating structure as claimed in claim 8, wherein vertices of respective n-sided planar polygonal surface (106, 108) of an n-strut twisted prism unit (100) of the multiple n-strut twisted prism units (100) are coupled to edges of respective n-sided planar polygonal surface (106, 108) of another n-strut twisted prism unit (100).

13. The floating structure as claimed in claim 1, wherein vertices of a side face of a beam adapter of the plurality of beam adapters (700, 900, 1100, 1200, 1500) are coupled to vertices of one n-sided planar polygonal surface from amongst multiple n-sided planar polygonal surfaces of one beam of the plurality of beams (200, 300, 400, 500, 600).

14. The floating structure as claimed in claim 13, wherein each of the vertices of the m-strut twisted prism unit (700) comprises:

a first plate (3102) having a first end (3104) and a second end (3106);

a second plate (3108) having a first end (3110) and a second end (3112), wherein the first end (3110) of the second plate (3108) abuts with the first end (3104) of first plate (3102), such that the second plate (3108) is inclined at an obtuse angle with the first plate (3102) and forming an outer face of a convex shape and an inner face of a concave shape;

a first integrated hinge-hook arrangement (3114) provided at the first plate (3102) and at the outer face for coupling to an end of a strut and a pre-tensioned rope forming a vertex of the n-sided planar polygonal surface of a beam;

a second integrated hinge-hook arrangement (3116) provided at the second plate (3108) and at the outer face for coupling to an end strut and a pre-tensioned rope forming a vertex of an n-sided planar polygonal surface of another beam;

a first hook (3118) provided towards the second end (3106) of the first plate (3102) and at the inner face for coupling to a pre-tensioned rope from an adjacent vertex provided towards the first plate (3102);

a second hook (3120) provided towards the second end (3112) of the second plate (3108) and at the inner face for coupling to a pre-tensioned rope from an adjacent vertex provided towards the second plate (3108); and a hinge (3122) provided between the first hook (3118) and the second hook (3120) and at the inner face for coupling one end of a strut of the m-strut twisted prism unit (700).

15. The floating structure as claimed in claim 1, wherein the m-strut twisted prism unit (802) has m number of struts arranged to form the m-strut twisted prism unit, ends of the struts form vertices of the m-sided polygonal top surface, vertices of the m-sided polygonal bottom surface, and vertices of the side faces formed as folded polygons, wherein pre-tensioned ropes attached to ends of adjacent struts form edges of the m-sided polygonal top surface and the m-sided polygonal bottom surface, wherein the vertices of each of the side faces formed as folded polygons are coupled to p-strut twisted prism unit (1202), p is equal to the number of vertices in each of the side faces of the m-strut twisted prism unit, wherein the p-strut twisted prism unit has a p-sided planar polygonal surface (1204) perpendicular to the m-sided polygonal top surface and the m-sided polygonal bottom surface.

16. The floating structure as claimed in claim 15, wherein the p-strut twisted prism unit (1202) has p number of struts of variable lengths, ends of the struts of the p-strut twisted prism unit form vertices of the p-sided planar polygonal surface (1204) and vertices of p-sided folded polygonal surface of the p-strut twisted prism unit, wherein the p-sided planar polygonal surface (1204) is coupled to an n-sided polygonal surface of a beam of the plurality of beams, and wherein the p-sided folded polygonal surface is in symmetry with the side faces formed as folded polygons of the m-strut twisted prism unit and vertices of the p-sided folded polygonal surface is coupled to the vertices of one of the side faces formed as folded polygons of the m-strut twisted prism unit.

17. The floating structure as claimed in claim 1, wherein each of the multiple n-strut twisted prism units of a beam of the plurality of beams is coupled to a corresponding n-strut twisted prism unit of the multiple n-strut twisted prism units of adjacent beam, and wherein the coupling is by one of a rope, a chain, and a cable.

18. The floating structure as claimed in claim 1, wherein the plurality of beam adapters is coupled to buoys (3202).

19. The floating structure as claimed in claim 1, wherein the plurality of beams is coupled to buoys (3202).

20. The floating structure as claimed in claim 1, wherein the plurality of beam adapters is coupled to anchors.

* * * * *